US012070059B2

(12) United States Patent
Patel et al.

(10) Patent No.: US 12,070,059 B2
(45) Date of Patent: Aug. 27, 2024

(54) CHILD-RESISTANT CONTAINER FOR TOBACCO-CONTAINING PRODUCTS

(71) Applicant: Nicoventures Trading Limited, London (GB)

(72) Inventors: Pankaj C. Patel, Clemmons, NC (US); Nicholas H. Watson, Westfield, NC (US); Ryan Bailey, Raleigh, NC (US); Michael Laut, Raleigh, NC (US); Luke Giduz, Raleigh, NC (US)

(73) Assignee: Nicoventures Trading Limited, London (GB)

( * ) Notice: Subject to any disclaimer, the term of this patent is extended or adjusted under 35 U.S.C. 154(b) by 498 days.

(21) Appl. No.: 17/012,908

(22) Filed: Sep. 4, 2020

(65) Prior Publication Data

US 2022/0071280 A1 Mar. 10, 2022

(51) Int. Cl.

| | |
|---|---|
| ***B65D 50/04*** | (2006.01) |
| ***A24F 23/00*** | (2006.01) |
| ***B65D 43/02*** | (2006.01) |

(52) U.S. Cl.

CPC ..... *A24F 23/00* (2013.01); *B65D 43/0212* (2013.01); *B65D 2215/00* (2013.01); *B65D 2543/00092* (2013.01)

(58) Field of Classification Search

CPC ..... B65D 50/045; B65D 50/066

See application file for complete search history.

(56) References Cited

U.S. PATENT DOCUMENTS

| | | | |
|---|---|---|---|
| 197,760 | A | 12/1877 | Brewer |
| 1,292,935 | A | 1/1919 | Walsh |
| 1,485,052 | A | 2/1924 | Reutter |
| 1,634,569 | A | 7/1927 | Bray |
| 2,504,850 | A | 4/1950 | Lermer |
| 2,722,328 | A | 11/1955 | Bell |
| 2,752,060 | A | 6/1956 | Martin |
| 2,827,193 | A | 3/1958 | Martin |
| 2,837,261 | A | 6/1958 | Stenger |
| 2,851,191 | A | 9/1958 | Semsch |
| 2,889,958 | A | 6/1959 | Af Ekenstam et al. |
| 2,917,162 | A | 12/1959 | Horland |
| 2,947,431 | A | 8/1960 | Haynes |
| 2,994,447 | A | 8/1961 | Haynes |
| 3,006,340 | A | 10/1961 | Meshberg |
| 3,019,931 | A | 2/1962 | Elbert |
| 3,027,034 | A | 3/1962 | Christian |

(Continued)

FOREIGN PATENT DOCUMENTS

| | | | |
|---|---|---|---|
| CA | 2428862 | A1 | 11/2004 |
| CA | 2536131 | C | 4/2012 |

(Continued)

OTHER PUBLICATIONS

World Intellectual Property Organization, ISR, Jan. 18, 2022.

(Continued)

*Primary Examiner* — Allan D Stevens

(74) *Attorney, Agent, or Firm* — Womble Bond Dickinson (US) LLP; Chris Humphrey; John V. Forcier

(57) ABSTRACT

The present disclosure relates to child resistant containers and methods of making same for products made or derived from tobacco, or that otherwise incorporate tobacco, and are intended for human consumption.

10 Claims, 18 Drawing Sheets

(56) References Cited

U.S. PATENT DOCUMENTS 3,050,219 A 8/1962 Sagarin et al.
3,065,846 A 11/1962 Amick
3,071,271 A 1/1963 Thomas
3,091,367 A 5/1963 Fredrickson
3,101,856 A 8/1963 Whiteman, Jr.
3,129,834 A 4/1964 Kimball
3,130,848 A 4/1964 Chancellor
3,130,862 A 4/1964 Lab
3,141,570 A 7/1964 Englesson et al.
3,173,565 A 3/1965 Alton, V
3,175,853 A 3/1965 Gilbertson
3,185,333 A 5/1965 Sharp
3,199,489 A 8/1965 Geigy et al.
3,200,979 A 8/1965 Powers
3,219,220 A 11/1965 Hakim
3,233,769 A 2/1966 Jessop
3,240,324 A 3/1966 Braun
3,261,490 A 7/1966 Gonsalves et al.
3,276,573 A 10/1966 Kaufman et al.
3,290,856 A 12/1966 Rumberger
3,292,293 A 12/1966 Giampiero et al.
3,302,775 A 2/1967 Finkelston, Jr. et al.
3,308,979 A 3/1967 Hailes
3,319,827 A 5/1967 Lalin et al.
3,323,688 A 6/1967 Sher et al.
3,324,996 A 6/1967 Jordt
3,334,763 A 8/1967 Grimm et al.
3,343,709 A 9/1967 Henderson et al.
3,349,935 A 10/1967 Cochin
3,355,067 A 11/1967 Martin et al.
3,360,147 A 12/1967 Schaefer
3,362,530 A 1/1968 Lab
3,365,088 A 1/1968 Wiser et al.
3,376,991 A 4/1968 Deaver
3,393,816 A 7/1968 Grimm
3,395,642 A 8/1968 Foster et al.
3,398,852 A 8/1968 Katz
3,399,796 A 9/1968 Maurice et al.
3,402,842 A 9/1968 Millian
3,402,850 A 9/1968 Barton et al.
3,403,803 A 10/1968 Markowitz
3,410,460 A 11/1968 Musher
3,419,137 A 12/1968 Walck, III
3,432,058 A 3/1969 Burgess
3,441,159 A 4/1969 Wiser et al.
3,445,022 A 5/1969 Cilluffo
3,451,576 A 6/1969 Lewis
3,454,194 A 7/1969 Becker
3,469,726 A 9/1969 Slack et al.
3,527,190 A 9/1970 Huck
3,608,762 A 9/1971 Fitzgerald
3,696,917 A 10/1972 Levi
3,830,393 A 8/1974 Schaefer
3,895,737 A 7/1975 Phillips
3,968,871 A 7/1976 Briscoe
4,126,224 A 11/1978 Laauwe et al.
4,219,116 A 8/1980 Borkan
4,254,871 A 3/1981 Poore
4,298,125 A 11/1981 Berghahn et al.
4,364,488 A 12/1982 Anjou et al.
4,375,858 A 3/1983 Shah et al.
4,444,326 A 4/1984 Musel
4,511,032 A 4/1985 Bush
4,561,544 A 12/1985 Reeve
4,611,727 A 9/1986 Graff
4,746,008 A 5/1988 Heverly et al.
4,759,455 A 7/1988 Wilson
4,787,526 A 11/1988 Pehr
4,826,026 A 5/1989 Gach et al.
4,833,819 A 5/1989 Sherman
4,890,742 A * 1/1990 Allison ..... B65D 50/045 206/811
4,940,167 A 7/1990 Fillmore et al.
5,019,125 A 5/1991 Esslinger et al.
5,033,634 A 7/1991 Hartsig et al.
5,080,222 A 1/1992 McNary
5,082,137 A 1/1992 Weinstein
5,150,793 A 9/1992 Tannenbaum
5,174,471 A 12/1992 Kozlowski et al.
5,249,676 A 10/1993 Ashcraft et al.
5,275,291 A 1/1994 Sledge
5,323,907 A 6/1994 Kalvelage
5,325,968 A 7/1994 Sowden
5,346,069 A 9/1994 Intini
5,356,017 A 10/1994 Rohr et al.
5,411,160 A * 5/1995 Goulet ..... B65D 43/0212 220/780
5,451,437 A 9/1995 Insley et al.
5,586,671 A 12/1996 Thomas et al.
5,657,901 A 8/1997 Farside
5,740,938 A 4/1998 Hofmann et al.
5,782,359 A 7/1998 McAllister et al.
5,816,441 A 10/1998 Farside
5,862,935 A * 1/1999 Dubois ..... B65D 1/46 220/326
5,873,482 A 2/1999 Conti
5,899,348 A 5/1999 Konefal et al.
5,909,822 A 6/1999 George et al.
5,915,560 A 6/1999 George et al.
5,979,680 A 11/1999 Farside
6,021,901 A 2/2000 Wolfe
6,047,829 A 4/2000 Johnstone et al.
6,095,364 A 8/2000 Dickie et al.
6,098,835 A 8/2000 DeJonge
6,146,729 A 11/2000 Nihda
6,170,710 B1 1/2001 Suffa
6,173,838 B1 1/2001 Brozell
6,286,520 B1 9/2001 Lin
6,349,831 B1 2/2002 Buss
6,375,956 B1 4/2002 Hermelin et al.
6,394,275 B1 5/2002 Paliotta et al.
6,564,967 B1 5/2003 Stringfield et al.
6,681,935 B1 1/2004 Lewis
6,997,320 B1 2/2006 Kancsar et al.
D625,178 S 10/2010 Bailey et al.
D631,353 S 1/2011 Gelardi et al.
D631,354 S 1/2011 Gelardi et al.
D631,747 S 2/2011 Gelardi et al.
7,878,324 B2 2/2011 Bellamah et al.
D638,297 S 5/2011 Gelardi et al.
7,946,450 B2 5/2011 Gelardi et al.
D639,162 S 6/2011 Gelardi et al.
D639,163 S 6/2011 Gelardi et al.
8,033,425 B2 10/2011 Gelardi
8,066,123 B2 11/2011 Gelardi
8,087,540 B2 1/2012 Bailey et al.
8,096,411 B2 1/2012 Bailey et al.
8,117,807 B2 2/2012 Bellamah et al.
D658,377 S 5/2012 Corwin et al.
D663,943 S 7/2012 Althorpe et al.
D667,301 S 9/2012 Jones et al.
D667,302 S 9/2012 Jones et al.
D667,303 S 9/2012 Jones et al.
D667,304 S 9/2012 Jones et al.
D673,848 S 1/2013 Bailey et al.
D674,688 S 1/2013 Loftin et al.
8,353,421 B2 1/2013 Rosazza et al.
8,360,235 B2 1/2013 Gibson
D675,516 S 2/2013 Horton et al.
D676,321 S 2/2013 Jones et al.
D677,163 S 3/2013 Jones et al.
D677,164 S 3/2013 Jones et al.
D678,067 S 3/2013 Jones et al.
8,393,465 B2 3/2013 Clark et al.
8,397,945 B2 3/2013 Gelardi et al.
8,413,832 B2 4/2013 Mazurkiewicz et al.
8,458,996 B2 6/2013 Bried et al.
D687,300 S 8/2013 Jones et al.
D688,938 S 9/2013 Bailey et al.
D689,772 S 9/2013 Jones et al.
8,540,113 B2 9/2013 Bailey
D690,588 S 10/2013 Pipes et al.
D692,298 S 10/2013 Pipes et al.
8,556,070 B2 10/2013 Bried et al.

(56) References Cited

U.S. PATENT DOCUMENTS

D702,765 S 4/2014 Williams
8,701,881 B2 4/2014 Gibson et al.
D704,050 S 5/2014 Pipes et al.
D709,953 S 7/2014 Williams
8,794,434 B2 8/2014 Scatterday et al.
8,869,980 B2 10/2014 Berggren
8,881,896 B2 11/2014 Gibson et al.
8,910,781 B2 12/2014 Pipes et al.
8,915,362 B2 12/2014 Erickson et al.
D727,723 S 4/2015 Pipes et al.
D727,724 S 4/2015 Pipes et al.
9,010,570 B2 4/2015 Gelardi et al.
9,016,512 B2 4/2015 Ichikawa et al.
9,032,969 B1 5/2015 Sinclair, Jr.
9,072,320 B2 7/2015 Coatney et al.
9,108,784 B2 8/2015 Pipes et al.
9,131,761 B2 9/2015 Kalyanpur et al.
9,248,935 B2 2/2016 Bailey et al.
9,321,568 B2 4/2016 Gelardi et al.
9,346,594 B2 5/2016 Pipes et al.
9,445,631 B1 9/2016 Patel et al.
9,468,233 B2 10/2016 Macko et al.
9,493,291 B2 11/2016 Pipes et al.
9,497,992 B2 11/2016 Evans
9,533,803 B1 * 1/2017 Giraud ..... B65D 50/06
9,538,785 B2 1/2017 Loos et al.
9,717,272 B2 8/2017 Patel et al.
9,731,876 B1 8/2017 Giraud et al.
9,795,165 B2 10/2017 Bried et al.
9,938,042 B1 4/2018 Anav et al.
10,076,753 B2 9/2018 Yi
10,285,439 B2 5/2019 Macko et al.
10,306,921 B2 6/2019 Hermans
10,463,075 B2 11/2019 Beardsall
10,548,347 B2 2/2020 Playford
D885,919 S 6/2020 Beardsall
10,986,859 B2 4/2021 Gerardi et al.
11,076,640 B2 8/2021 Bjoerkholm
11,097,872 B2 8/2021 Evans
11,291,237 B2 4/2022 Rushforth et al.
2002/0100487 A1 8/2002 St. Charles et al.
2002/0162768 A1 11/2002 Bolnick et al.
2002/0175137 A1 11/2002 Rousselet
2003/0015438 A1 1/2003 Huffman et al.
2003/0085262 A1 5/2003 Evans et al.
2003/0102321 A1 6/2003 Maietta
2003/0183551 A1 10/2003 Hulick et al.
2003/0209558 A1 11/2003 Cross
2004/0016763 A1 1/2004 Hilliard
2004/0035740 A1 2/2004 Paliotta et al.
2004/0035876 A1 2/2004 Lo et al.
2004/0050748 A1 3/2004 Ehrlund
2004/0055613 A1 3/2004 Horian
2004/0074917 A1 4/2004 McHutchinson et al.
2004/0089668 A1 5/2004 Lambelet et al.
2004/0108322 A1 6/2004 Maietta et al.
2004/0111836 A1 6/2004 Agler et al.
2004/0159625 A1 8/2004 Kwon
2004/0168945 A1 9/2004 Houze et al.
2004/0173497 A1 9/2004 Kancsar et al.
2004/0178112 A1 9/2004 Flynn et al.
2004/0181195 A1 9/2004 Bennwik et al.
2004/0187882 A1 9/2004 Henrikus et al.
2004/0188311 A1 9/2004 Paliotta et al.
2004/0188313 A1 9/2004 Tedham et al.
2004/0256277 A1 12/2004 Gedanke
2005/0011773 A1 1/2005 Intini
2005/0172964 A1 8/2005 Anderson et al.
2005/0183981 A1 8/2005 Gelardi
2005/0205598 A1 9/2005 Gelardi et al.
2005/0274643 A1 12/2005 Arnold et al.
2006/0086640 A1 4/2006 Leslie et al.
2006/0124658 A1 6/2006 Coe et al.
2006/0131205 A1 6/2006 Marcus et al.
2006/0180604 A1 8/2006 Ginsberg et al.
2006/0231453 A1 10/2006 Shilajeet et al.
2006/0283721 A1 12/2006 Kutsch et al.
2006/0283760 A1 12/2006 Nivala
2007/0012711 A1 1/2007 Deverry et al.
2007/0045147 A1 3/2007 Albrecht et al.
2007/0045149 A1 3/2007 Hession
2007/0054525 A1 3/2007 Jones et al.
2007/0084747 A1 4/2007 Gherdan et al.
2007/0102318 A1 5/2007 Bertram et al.
2007/0144996 A1 6/2007 Sawyer
2007/0151893 A1 7/2007 Gherdan, Jr. et al.
2007/0246395 A1 10/2007 Arnold et al.
2007/0261984 A1 11/2007 Gelardi et al.
2007/0284277 A1 12/2007 Gnepper et al.
2007/0284372 A1 12/2007 Gnepper et al.
2007/0289893 A1 12/2007 Williams, Jr.
2008/0017542 A1 1/2008 Freeze et al.
2008/0027291 A1 1/2008 Hartman et al.
2008/0078690 A1 4/2008 Zumbiel
2008/0105582 A1 5/2008 Michael et al.
2008/0156686 A1 7/2008 Hluchan et al.
2008/0164259 A1 7/2008 Coe et al.
2008/0197043 A1 8/2008 Freeze et al.
2008/0200321 A1 8/2008 Bittner et al.
2008/0251410 A1 10/2008 Gelardi et al.
2008/0257773 A1 10/2008 Gelardi et al.
2008/0272022 A1 11/2008 Kulkarni et al.
2008/0283434 A1 11/2008 Gelardi
2008/0290109 A1 11/2008 Williams
2008/0290110 A1 11/2008 Gelardi et al.
2009/0008391 A1 1/2009 Bjoerkholm et al.
2009/0014350 A1 1/2009 Gaumont
2009/0014450 A1 1/2009 Bjoerkholm et al.
2009/0045078 A1 2/2009 Freeze et al.
2009/0057173 A1 3/2009 Mitten et al.
2009/0065383 A1 3/2009 Schardt et al.
2009/0084801 A1 4/2009 Coe
2009/0178949 A1 7/2009 Reilley et al.
2009/0183744 A1 7/2009 Beardsall et al.
2009/0184023 A1 7/2009 Brollier et al.
2009/0194434 A1 8/2009 Ellis et al.
2009/0200332 A1 8/2009 Intini
2009/0223989 A1 9/2009 Gelardi
2009/0236357 A1 9/2009 Giraud et al.
2009/0250360 A1 10/2009 Griffin et al.
2009/0266837 A1 10/2009 Gelardi et al.
2009/0272081 A1 11/2009 Panson et al.
2009/0283437 A1 11/2009 Angelucci et al.
2009/0283439 A1 11/2009 Barndt et al.
2009/0283440 A1 11/2009 Krumme et al.
2010/0011714 A1 1/2010 Royer
2010/0065076 A1 3/2010 Beijer et al.
2010/0078341 A1 4/2010 Rasmussen et al.
2010/0084308 A1 4/2010 Rigby
2010/0084414 A1 4/2010 Dehlin et al.
2010/0084424 A1 4/2010 Bailey et al.
2010/0126886 A1 5/2010 Le et al.
2010/0133140 A1 6/2010 Bailey et al.
2010/0163561 A1 7/2010 Gelardi et al.
2010/0181335 A1 7/2010 Farrar et al.
2010/0193395 A1 8/2010 Mowery
2010/0193397 A1 8/2010 Farrar et al.
2010/0206320 A1 8/2010 Hodgson et al.
2010/0236944 A1 9/2010 Dehlin et al.
2010/0243488 A1 9/2010 Gibson
2010/0243509 A1 9/2010 Gelardi et al.
2010/0264157 A1 10/2010 Bailey et al.
2010/0288669 A1 11/2010 Arndt et al.
2010/0294692 A1 11/2010 Gelardi et al.
2010/0307113 A1 12/2010 Atchley et al.
2010/0326999 A1 12/2010 Farrar et al.
2011/0000814 A1 1/2011 Guschke et al.
2011/0011765 A1 1/2011 Bogdziewicz, III et al.
2011/0036743 A1 2/2011 Wharton
2011/0042256 A1 2/2011 Greenland et al.
2011/0042262 A1 2/2011 Harakchand et al.
2011/0042375 A1 2/2011 Jones et al.
2011/0067363 A1 3/2011 Merck et al.
2011/0068039 A1 3/2011 Sack et al.

(56) References Cited

U.S. PATENT DOCUMENTS

2011/0068041 A1 3/2011 Harakchand et al.
2011/0083685 A1 4/2011 Adams et al.
2011/0086194 A1 4/2011 Williams
2011/0114512 A1 5/2011 Gelardi
2011/0114527 A1 5/2011 Thomas
2011/0127320 A1 6/2011 Fraser et al.
2011/0132795 A1 6/2011 Silverman
2011/0155756 A1 6/2011 Ballard et al.
2011/0163156 A1 7/2011 Bogdziewicz, III et al.
2011/0168712 A1 7/2011 Bailey et al.
2011/0168732 A1 7/2011 Antunes et al.
2011/0186469 A1 8/2011 Sack et al.
2011/0204074 A1* 8/2011 Gelardi ..... B65D 85/10 277/312
2011/0225936 A1 9/2011 Craft et al.
2011/0226765 A1 9/2011 Gelardi et al.
2011/0231006 A1 9/2011 Saltsov et al.
2011/0272426 A1 11/2011 Lewis et al.
2012/0006707 A1 1/2012 Krumme et al.
2012/0012498 A1 1/2012 Paliotta et al.
2012/0037517 A1 2/2012 Grosskopf
2012/0097735 A1 4/2012 Hultberg et al.
2012/0125805 A1 5/2012 Myszak
2012/0145585 A1 6/2012 Doyle et al.
2012/0152779 A1 6/2012 Akhtar et al.
2012/0160724 A1 6/2012 Gelardi et al.
2012/0160726 A1 6/2012 Gelardi et al.
2012/0193265 A1 8/2012 Patel et al.
2012/0205276 A1 8/2012 Shackford
2012/0217183 A1 8/2012 Gelardi et al.
2012/0234701 A1 9/2012 Albrecht et al.
2012/0234854 A1 9/2012 Bailey et al.
2012/0260612 A1 10/2012 Basak et al.
2012/0261275 A1 10/2012 Intini et al.
2012/0261285 A1 10/2012 Holloway et al.
2012/0267261 A1 10/2012 Gelardi et al.
2012/0285125 A1 11/2012 Bailey et al.
2013/0026175 A1 1/2013 Reichardt et al.
2013/0075462 A1 3/2013 Jones et al.
2013/0126379 A1 5/2013 Medhal et al.
2013/0140200 A1 6/2013 Scatterday
2013/0140201 A1 6/2013 Biondi et al.
2013/0186416 A1 7/2013 Gao et al.
2013/0256163 A1 10/2013 Tom et al.
2013/0285681 A1 10/2013 Dean et al.
2013/0292279 A1 11/2013 Bengtsson et al.
2013/0292398 A1 11/2013 Cote et al.
2014/0001194 A1 1/2014 Clark et al.
2014/0097113 A1 4/2014 Babineau et al.
2014/0216968 A1 8/2014 Wagner et al.
2014/0238877 A1 8/2014 Petrucci et al.
2014/0251842 A1 9/2014 Pipes et al.
2014/0262839 A1 9/2014 Le et al.
2014/0305832 A1 10/2014 Andersson et al.
2014/0305834 A1 10/2014 Knutson et al.
2014/0339121 A1 11/2014 Gelardi et al.
2014/0346081 A1 11/2014 Sowden et al.
2015/0014203 A1 1/2015 Upchurch et al.
2015/0021326 A1 1/2015 Giraud et al.
2015/0090686 A1 4/2015 Batzel et al.
2015/0136800 A1 5/2015 Dodo et al.
2015/0203243 A1 7/2015 Schwester
2015/0245654 A1 9/2015 Memari et al.
2015/0245980 A1 9/2015 Johnston et al.
2015/0274401 A1 10/2015 Mabe et al.
2015/0283029 A1 10/2015 Riis et al.
2015/0307246 A1 10/2015 Patwardhan
2015/0307248 A1 10/2015 Patwardhan et al.
2015/0320113 A1 11/2015 Stebbins et al.
2015/0321787 A1 11/2015 Stebbins et al.
2015/0351456 A1 12/2015 Johnson et al.
2016/0001948 A1 1/2016 Collins et al.
2016/0023816 A1 1/2016 Giraud et al.
2016/0039591 A1 2/2016 Kinzer
2016/0081391 A1 3/2016 Makarem et al.
2016/0083170 A1 3/2016 Grosskopf
2016/0101891 A1 4/2016 Bailey et al.
2016/0106149 A1 4/2016 Potter et al.
2016/0106150 A1 4/2016 Garcia et al.
2016/0107796 A1 4/2016 Sibley
2016/0120744 A1 5/2016 Hammond et al.
2016/0120745 A1 5/2016 Hammond et al.
2016/0120746 A1 5/2016 Hammond et al.
2016/0120747 A1 5/2016 Hammond et al.
2016/0120748 A1 5/2016 Hammond et al.
2016/0122105 A1 5/2016 Hammond et al.
2016/0130045 A1 5/2016 Giraud et al.
2016/0130074 A1 5/2016 Kastha et al.
2016/0143808 A1 5/2016 Pattison et al.
2016/0144997 A1 5/2016 Williams-Hartman
2016/0159555 A1 6/2016 Park
2016/0176617 A1 6/2016 Bolognia et al.
2016/0272382 A1 9/2016 Wagner et al.
2016/0311587 A1 10/2016 Schneider et al.
2016/0318651 A1 11/2016 Jones et al.
2016/0325873 A1 11/2016 Smith et al.
2016/0338909 A1 11/2016 Feld
2016/0347524 A1 12/2016 Jones et al.
2016/0360783 A1 12/2016 Patel et al.
2016/0368670 A1 12/2016 Beardsall
2017/0008683 A1 1/2017 Ryan et al.
2017/0057688 A1 3/2017 Patwardhan et al.
2017/0057711 A1 3/2017 Coker et al.
2017/0073130 A1 3/2017 Giraud et al.
2017/0081097 A1 3/2017 Vercoe et al.
2017/0100308 A1 4/2017 Lampe et al.
2017/0107038 A1 4/2017 Kim et al.
2017/0137167 A1 5/2017 Warner
2017/0210531 A1 7/2017 Parker et al.
2017/0217658 A1 8/2017 Whitehurst
2017/0225854 A1 8/2017 Brotzel et al.
2017/0231867 A1 8/2017 Maston et al.
2017/0239144 A1 8/2017 Holland et al.
2017/0267396 A1 9/2017 Hammond et al.
2017/0283154 A1 10/2017 Karles et al.
2017/0297803 A1 10/2017 Chambers et al.
2017/0325500 A1 11/2017 Senftleben et al.
2017/0327291 A1 11/2017 Senftleben et al.
2017/0332693 A1 11/2017 Benford
2017/0341814 A1 11/2017 Altus et al.
2017/0341829 A1 11/2017 Rehders
2017/0349338 A1 12/2017 Ziering et al.
2017/0360092 A1 12/2017 Althorpe et al.
2017/0367407 A1 12/2017 Althorpe et al.
2018/0000691 A1 1/2018 Holland et al.
2018/0037380 A1 2/2018 Giraud et al.
2018/0037381 A1 2/2018 White et al.
2018/0086518 A1 3/2018 Charm
2018/0099797 A1 4/2018 Biesecker, II et al.
2018/0118429 A1 5/2018 Khoury
2018/0140001 A1 5/2018 Gabbay
2018/0153769 A1 6/2018 Dey et al.
2018/0155097 A1 6/2018 Hinnerud et al.
2018/0168222 A1 6/2018 Nersing et al.
2018/0319556 A1* 11/2018 Straughan ..... B65D 43/0212
2019/0047755 A1* 2/2019 Giraud ..... B65D 50/045
2019/0239562 A1* 8/2019 Beardsall ..... B65D 43/0212
2020/0277110 A1* 9/2020 Patel ..... A24F 23/00
2021/0300640 A1* 9/2021 Ludewig ..... B65D 50/046
2022/0000175 A1 1/2022 Patel et al.
2022/0071280 A1 3/2022 Patel et al.
2022/0104543 A1 4/2022 Patel et al.

FOREIGN PATENT DOCUMENTS

DE 2933955 A1 3/1981
DE 3210361 A1 10/1983
EP 1088769 A1 4/2001
EP 1481913 A1 12/2004
EP 1700796 B1 7/2008
EP 1700797 B1 7/2008
EP 2002856 A1 12/2008
EP 2308769 B1 1/2013
EP 2540641 B1 1/2015

(56) References Cited

FOREIGN PATENT DOCUMENTS

| | | | |
|---|---|---|---|
| GB | 1502258 | A | 3/1978 |
| GB | 1511664 | A | 5/1978 |
| GB | 2042476 | A | 9/1980 |
| GB | 2319244 | A | 5/1998 |
| GB | 2423757 | A | 9/2006 |
| GB | 2512620 | A | 10/2014 |
| GB | 2555096 | A | 4/2018 |
| WO | 9312007 | A1 | 6/1993 |
| WO | 9607601 | A1 | 3/1996 |
| WO | 9948391 | A1 | 9/1999 |
| WO | 0043287 | A1 | 7/2000 |
| WO | 0135772 | A1 | 5/2001 |
| WO | 04103857 | A1 | 12/2004 |
| WO | 2005016036 | A1 | 2/2005 |
| WO | 05021398 | A2 | 3/2005 |
| WO | 07036714 | A1 | 4/2007 |
| WO | 07065240 | A1 | 6/2007 |
| WO | 07143993 | A2 | 12/2007 |
| WO | 09000890 | A2 | 12/2008 |
| WO | 10015638 | A1 | 2/2010 |
| WO | 2010060845 | A1 | 6/2010 |
| WO | 11116091 | A1 | 9/2011 |
| WO | 12003978 | A1 | 1/2012 |
| WO | 13014462 | A1 | 1/2013 |
| WO | 13099874 | A1 | 7/2013 |
| WO | 2013142671 | A1 | 9/2013 |
| WO | 13151806 | A1 | 10/2013 |
| WO | 13187780 | A1 | 12/2013 |
| WO | 14085625 | A1 | 6/2014 |
| WO | 14198935 | A1 | 12/2014 |
| WO | 15066109 | A1 | 5/2015 |
| WO | 16023651 | A1 | 2/2016 |
| WO | 16079151 | A1 | 5/2016 |
| WO | 16122417 | A1 | 8/2016 |
| WO | 17034560 | A1 | 3/2017 |
| WO | 17046334 | A1 | 3/2017 |
| WO | 17102686 | A1 | 6/2017 |
| WO | 17125405 | A1 | 7/2017 |
| WO | 18007903 | A1 | 1/2018 |
| WO | 18015712 | A1 | 1/2018 |
| WO | 18081681 | A1 | 5/2018 |
| WO | WO-2021223009 | A1 | 11/2021 |
| WO | WO-2022242954 | A1 | 11/2022 |
| WO | WO-2022263038 | A1 | 12/2022 |

OTHER PUBLICATIONS

World Intellectual Property Organization, IPRP for PCT Application No. PCT/IB2021/058074, mailed Mar. 16, 2023, pp. 1-9.

* cited by examiner

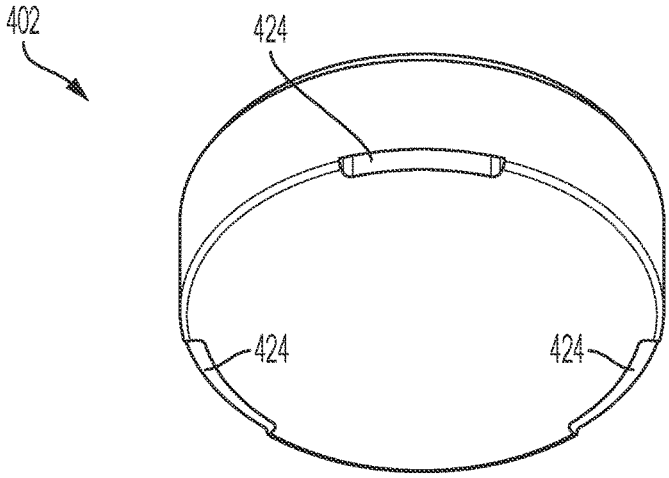
FIG. 5A
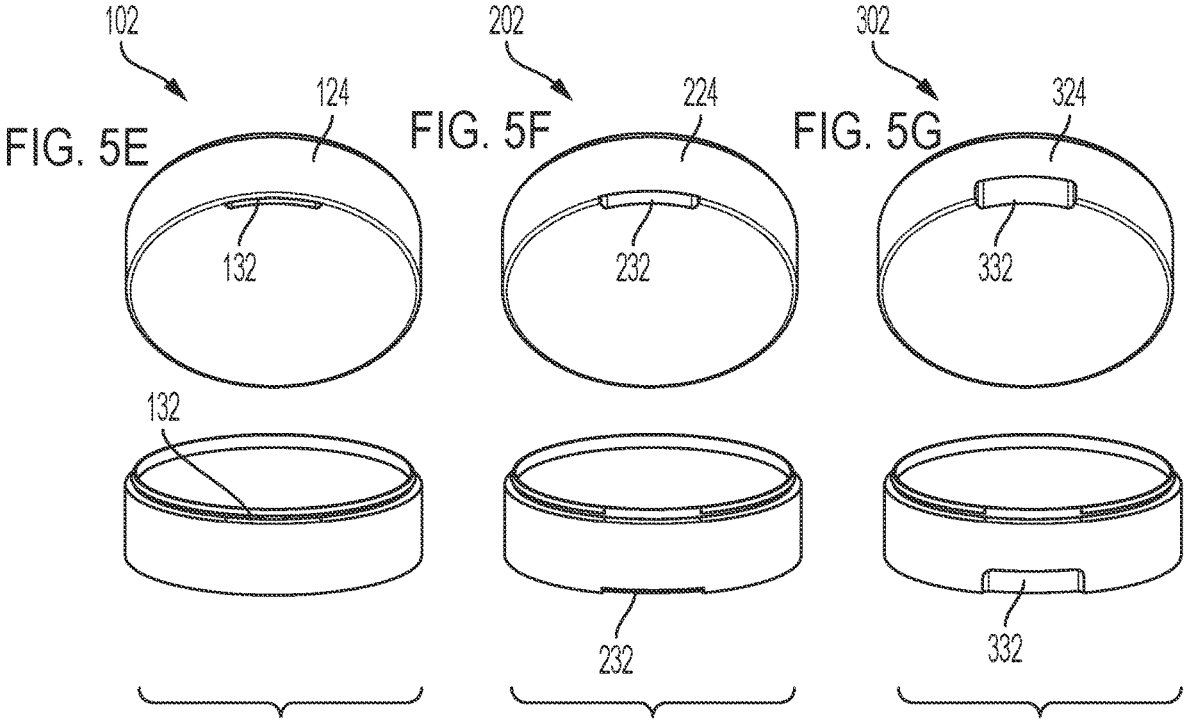
FIG. 5E FIG. 5F FIG. 5G
FIG. 5B FIG. 5C FIG. 5D

CHILD-RESISTANT CONTAINER FOR TOBACCO-CONTAINING PRODUCTS

TECHNOLOGICAL FIELD

The present disclosure relates to containers and related packaging methods for products made or derived from tobacco, or that otherwise incorporate tobacco, and are intended for human consumption. More particularly, this disclosure relates to child resistant containers.

BACKGROUND

Tobacco may be enjoyed in a so-called "smokeless" form. Particularly popular smokeless tobacco products are employed by inserting some form of processed tobacco or tobacco-containing formulation into the mouth of the user. See, for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,126 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; U.S. Pat. No. 8,336,557 to Kumar et al.; U.S. Pat. No. 8,469,036 to Strickland et al.; U.S. Pat. No. 8,627,828 to Strickland et al.; U.S. Pat. No. 8,940,344 to Crawford et al.; and U.S. Pat. No. 9,155,772 to Gao et al.; and U.S. Pat. Pub. Nos. 2004/0020503 to Williams; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2009/0065013 to Essen et al.; and 2013/0206153 to Beeson et al.; PCT Pub. Nos. WO 04/095959 to Arnarp et al.; and WO 100/134,444 to Atchley; each of which is incorporated herein by reference.

Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA.

Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

Various types of containers for dispensing moistened solid components, particularly components intended for human consumption, are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; D574,709 to Crotts et al. and D649,284 to Patel et al.; U.S. Patent Pub. Nos. 2008/0202956 to Welk et al., 2010/0012534 to Hoffman, 2010/0018883 to Patel et al., and 2014/0197054 to Pipes et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety.

A desirable feature for certain containers is the incorporation of child-resistant features that make it difficult for children to open or otherwise access the contents of the container, thereby reducing the risk of poisoning in children via the ingestion of potentially hazardous items. However, such features may increase the cost and complexity of the container and the manufacturing thereof.

BRIEF SUMMARY

Example implementations of the present disclosure are directed to child-resistant containers having a base or body portion and a cover or lid, where the cover, the body portion, or both include structure to make it difficult for a child to separate the cover and the body portion, thereby reducing the risk of children accessing the contents of the container. However, typical adults will have sufficient strength to separate the cover and body portion. In addition, the container may include a visual and/or tactical cue to assist an adult with opening.

The present disclosure includes, without limitation, the following example implementations.

Some example implementations provide a container including a body portion defining an internal space accessible via an opening and a cover configured to securely and removably engage the body portion. The body portion has a bottom wall and a sidewall extending upwardly from a peripheral edge of the bottom wall, where the sidewall includes a primary wall extending along a perimeter of the bottom wall and having an inner surface and an outer surface and an upper rim defining the opening, and a secondary wall spaced inwardly from and at least partially surrounding a portion of the inner surface of the primary wall thereby defining a channel between the primary and secondary walls, where the secondary wall has a first vertical edge, a second vertical edge, a top horizontal edge, and a bottom horizontal edge and the secondary wall is coupled to the primary wall along the first and second vertical edges, thereby defining a top gap between the top horizontal edge of the secondary wall and the primary wall proximate the upper rim and a bottom gap between the bottom horizontal edge of the secondary wall and the primary wall proximate the peripheral edge of the bottom wall, such that a portion of the primary wall flexes relative to the secondary wall upon application of a force thereto (i.e., when depressed). The primary wall returns to an unflexed or neutral position after removal of the force.

Additional example implementations provide a container including a body portion defining an internal space accessible via an opening and a cover configured to securely and removably engage the body portion. The body portion includes a bottom wall and a sidewall extending upwardly from a peripheral edge of the bottom wall, the sidewall extending along a perimeter of the bottom wall and having an inner surface and an outer surface and an upper rim defining the opening, where a portion of the sidewall has a gap extending along a length of the sidewall and between the inner and outer surfaces, such that the gap defines a channel running from an area proximate the upper rim to an area proximate the peripheral edge of the bottom wall, such that the outer surface of the sidewall flexes relative to the inner surface of the sidewall upon application of a force thereto. The sidewall returns to an unflexed or neutral position after removal of the force.

In some example implementations of the container of any preceding example implementation, or any combination of any preceding example implementations, the cover comprises a top wall and a sidewall extending downwardly from and about a peripheral edge of the top wall.

In some example implementations of the container of any preceding example implementation, or any combination of any preceding example implementations, the sidewall of the cover engages with at least a portion of the sidewall of the body portion.

In some example implementations of the container of any preceding example implementation, or any combination of any preceding example implementations, the cover is removable by flexing a portion of the primary wall aligning with the secondary wall inwardly to expose an edge of the sidewall of the cover.

In some example implementations of the container of any preceding example implementation, or any combination of any preceding example implementations, the cover engages the body portion via an interference fit or a snap fit.

In some example implementations of the container of any preceding example implementation, or any combination of any preceding example implementations, an outer surface of the cover sidewall is configured to sit substantially flush with the outer surface of the sidewall of the body portion when engaged.

In some example implementations of the container of any preceding example implementation, or any combination of any preceding example implementations, at least a portion of the cover sidewall and a portion of the body portion sidewall abut when engaged.

In some example implementations of the container of any preceding example implementation, or any combination of any preceding example implementations, the sidewall of the body portion comprises a plurality of secondary walls, each spaced inwardly from and at least partially surrounding a portion of the inner surface of the primary wall, the secondary walls and the primary wall defining a plurality of channels therebetween, wherein each secondary wall comprises a first vertical edge, a second vertical edge, a top horizontal edge, and a bottom horizontal edge and each secondary wall is coupled to the primary wall along their respective first and second vertical edges, thereby defining top gaps between the top horizontal edges of the secondary walls and the primary wall proximate the upper rim and bottom gaps between the bottom horizontal edges of the secondary walls and the primary wall proximate the peripheral edge of the bottom wall, such that the portions of the primary wall flex relative to the plurality of secondary walls upon application of a force thereto.

In some example implementations of the container of any preceding example implementation, or any combination of any preceding example implementations, the secondary walls are spaced equidistant about a perimeter of the body portion.

In some example implementations of the container of any preceding example implementation, or any combination of any preceding example implementations, a plurality of portions of the sidewall each comprise a gap extending along a length of the sidewall and between the inner and outer surfaces, such that each gap defines a channel running from an area proximate the upper rim to an area proximate the bottom wall and the outer surfaces of the plurality of portions of the sidewall flex relative to the inner surface of the sidewall upon application of a force thereto.

In some example implementations of the container of any preceding example implementation, or any combination of any preceding example implementations, the portions of the sidewall comprising a gap are spaced equidistant about a perimeter of the body portion.

In some example implementations of the container of any preceding example implementation, or any combination of any preceding example implementations, the cover further comprises an inner ring extending downwardly from the top wall and spaced inwardly from the sidewall, wherein the cover is configured to provide an interference fit between the cover and the sidewall of the body portion.

In some example implementations of the container of any preceding example implementation, or any combination of any preceding example implementations, the inner ring comprises a plurality of non-contiguous segments.

In some example implementations of the container of any preceding example implementation, or any combination of any preceding example implementations, the cover comprises a top wall, an outer sidewall extending downwardly from a peripheral edge of the top wall, and an inner sidewall or ring extending downwardly from the top wall and spaced inwardly from the outer sidewall, wherein the outer and inner sidewalls define a receptacle configured to engage at least a portion the sidewall of the body portion via an interference fit.

Additional example implementations provide a container comprising a body portion defining an internal space accessible via an opening, the body portion comprising a bottom wall and a sidewall extending upwardly from a peripheral edge of the bottom wall; and a cover configured to securely and removably engage the body portion, the cover comprising a top wall; an outer sidewall extending downwardly from a peripheral edge of the top wall; and an inner sidewall extending downwardly from the top wall and spaced inwardly from the outer sidewall, wherein the outer and inner sidewalls define a receptacle configured to engage at least a portion of the sidewall of the body portion via an interference fit.

In some example implementations of the container of any preceding example implementation, or any combination of any preceding example implementations, the inner sidewall comprises a plurality of non-contiguous segments.

In some example implementations of the container of any preceding example implementation, or any combination of any preceding example implementations, the cover further comprises a plurality of buttresses spaced about an inner perimeter of the inner sidewall and coupled to the top wall.

In some example implementations of the container of any preceding example implementation, or any combination of any preceding example implementations, the buttresses are spaced equidistant about the inner perimeter of the inner sidewall.

In some example implementations of the container of any preceding example implementation, or any combination of any preceding example implementations, the sidewall of the body portion comprises an inner surface and an outer surface and an upper rim defining the opening, a portion of the sidewall of the body portion comprises a gap extending along a length of the sidewall and between the inner and outer surfaces, such that the gap defines a channel running from an area proximate the upper rim to an area proximate the peripheral edge of the bottom wall, such that the outer surface of the sidewall flexes relative to the inner surface of the sidewall upon the application of a force thereto. The sidewall returns to an unflexed or neutral position after removal of the force.

In some example implementations of the container of any preceding example implementation, or any combination of any preceding example implementations, the sidewall of the body portion comprises a primary wall extending along a perimeter of the bottom wall and having an inner surface and an outer surface and an upper rim defining the opening; and a secondary wall spaced inwardly from and at least partially surrounding a portion of the inner surface of the primary wall thereby defining a channel between the primary and secondary walls, wherein the secondary wall comprises a first vertical edge, a second vertical edge, a top horizontal edge, and a bottom horizontal edge and the secondary wall is coupled to the primary wall along the first and second vertical edges, thereby defining a top gap between the top horizontal edge of the secondary wall and the primary wall proximate the upper rim and a bottom gap between the bottom horizontal edge of the secondary wall and the primary wall proximate the peripheral edge of the bottom wall, such that a portion of the primary wall flexes relative to the secondary wall upon the application of a force thereto. The primary wall returns to an unflexed or neutral position after removal of the force.

Additional example implementations provide a method for manufacturing a container comprising providing a body portion according to any one of the example implementations disclosed herein, where the body portion defines an internal space accessible via an opening, and providing a cover configured to engage the body portion so as to cover the opening and enclose the internal space.

Additional example implementations provide a method for manufacturing a container comprising providing a body portion defining an internal space accessible via an opening, the body portion comprising a bottom wall and a sidewall extending upwardly from a peripheral edge of the bottom wall; and providing a cover configured to securely and removably engage the body portion so as to cover the opening and enclose the internal space, the cover comprising a top wall; an outer sidewall extending downwardly from a peripheral edge of the top wall; and an inner sidewall extending downwardly from the top wall and spaced inwardly from the outer sidewall, wherein the outer and inner sidewalls define a receptacle configured to engage at least a portion the sidewall of the body portion via an interference fit.

In some example implementations of the container of any preceding example implementation, or any combination of any preceding example implementations, the cover comprises a top wall; an outer sidewall extending downwardly from a peripheral edge of the top wall; and an inner sidewall extending downwardly from the top wall and spaced inwardly from the outer sidewall, wherein the outer and inner sidewalls define a receptacle configured to engage at least a portion the sidewall of the body portion via an interference fit.

In some example implementations of the container of any preceding example implementation, or any combination of any preceding example implementations, at least one of the body portion or the cover are manufactured via injection molding.

In some example implementations of the container of any preceding example implementation, or any combination of any preceding example implementations, at least one of the body portion or the cover comprises a polypropylene.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1A:
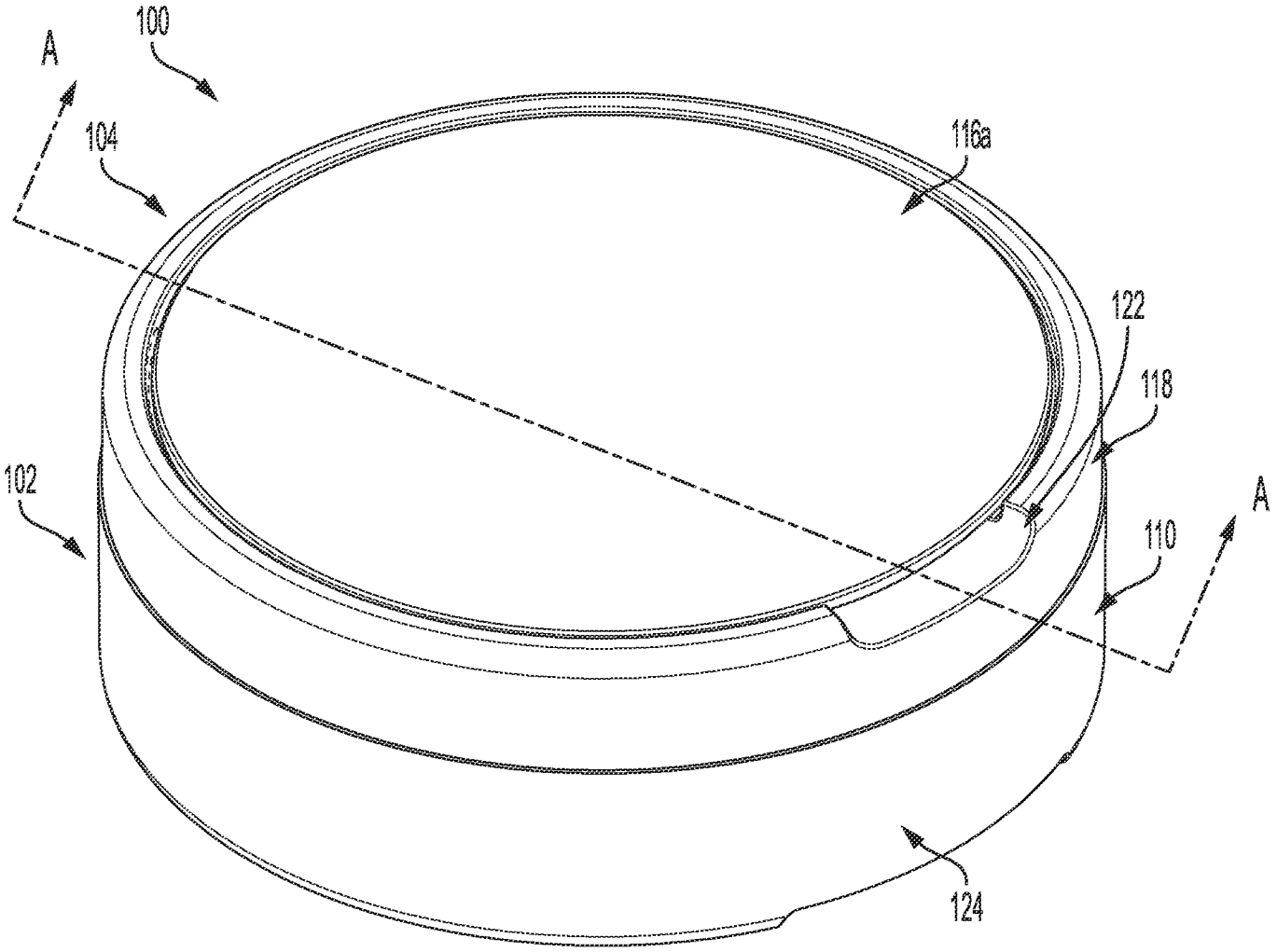
Figure 1B:
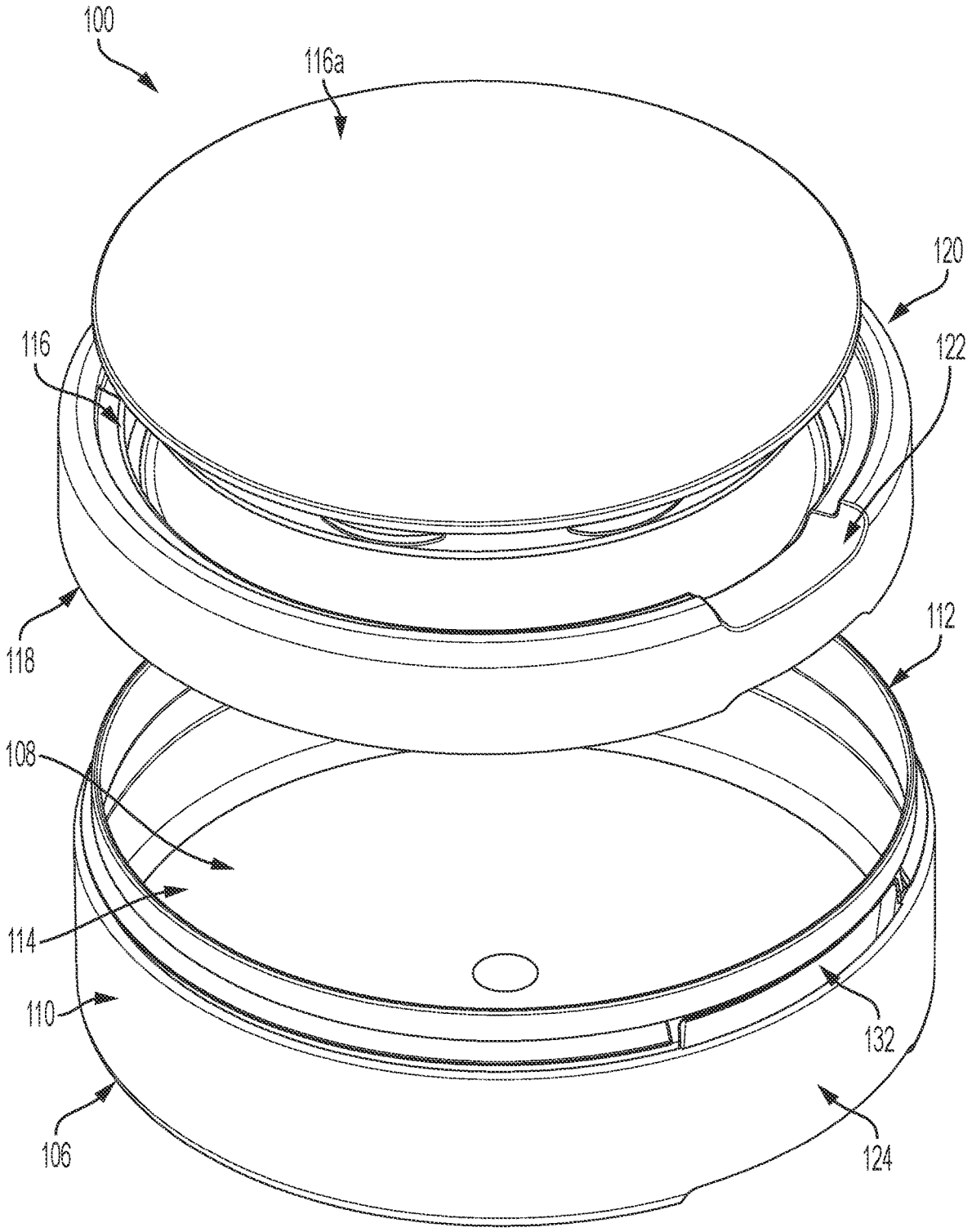
Figure 2:
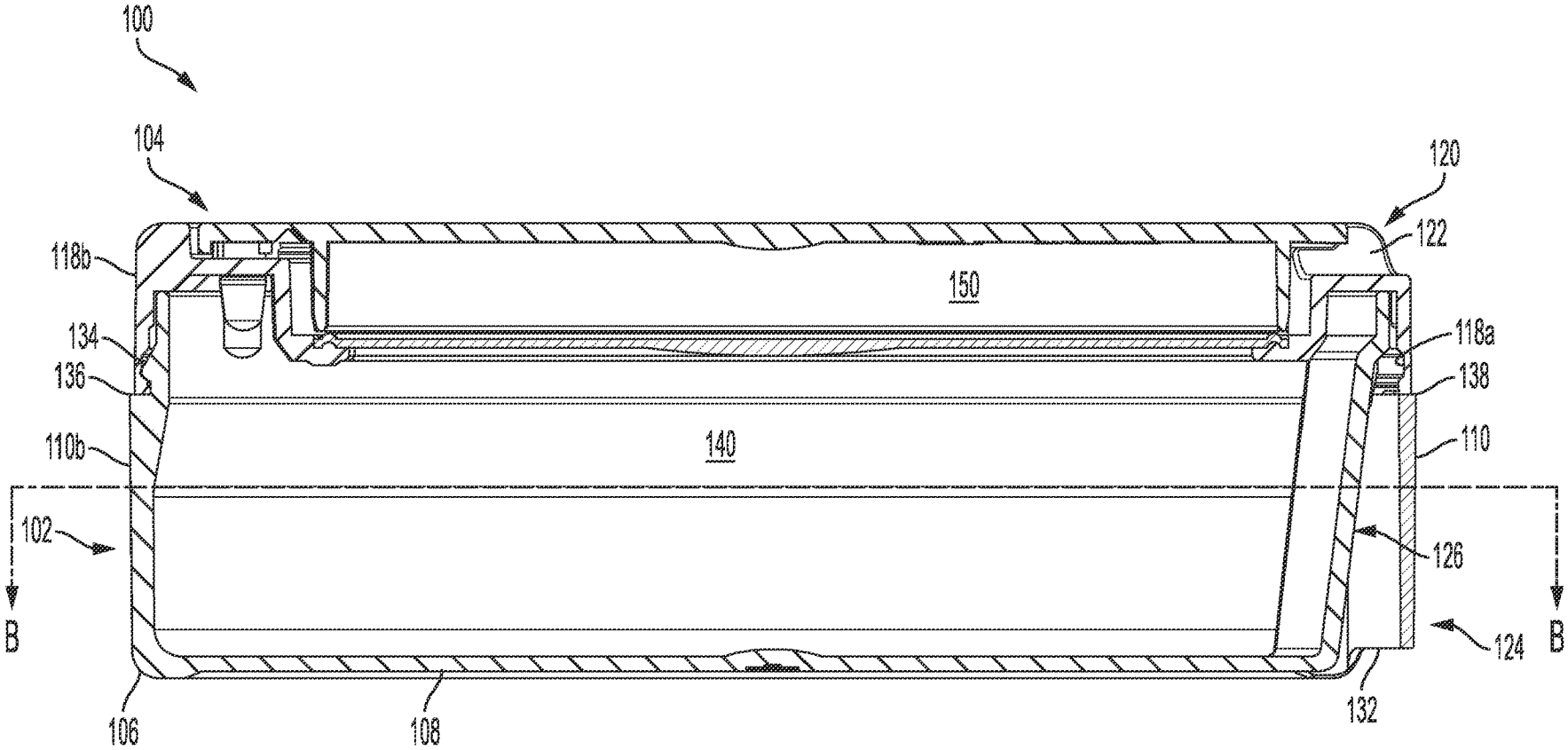
Figure 3:
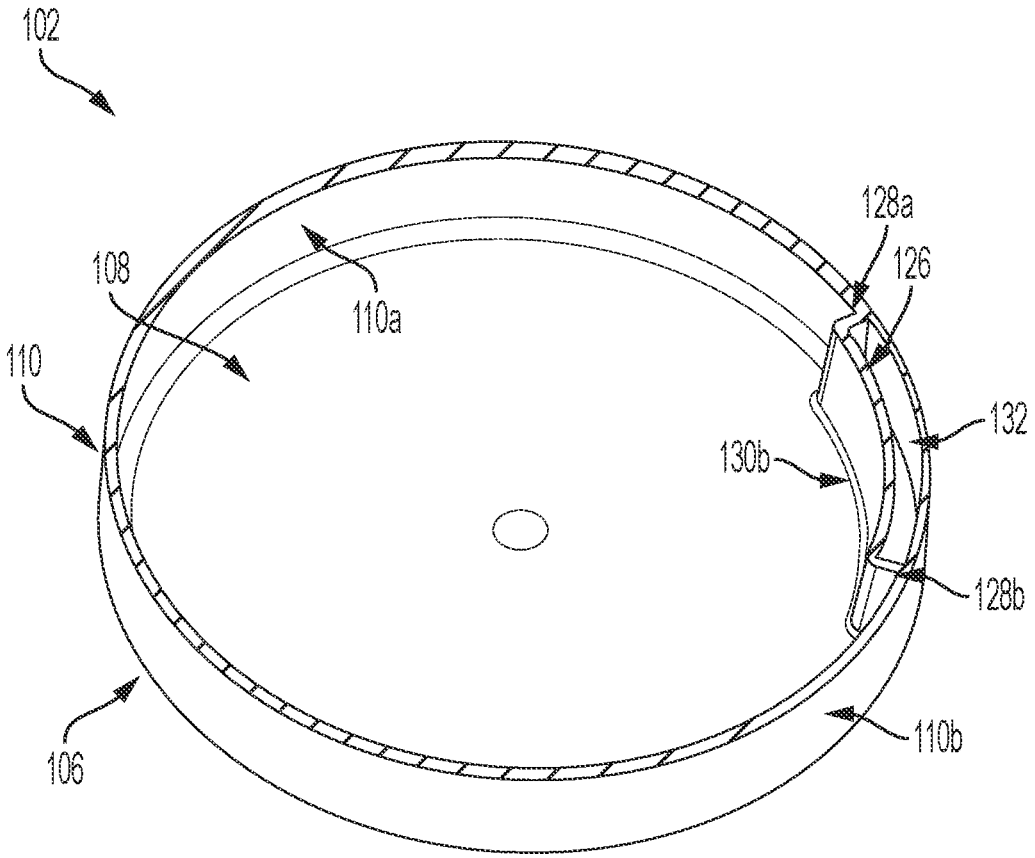
Figure 6A:
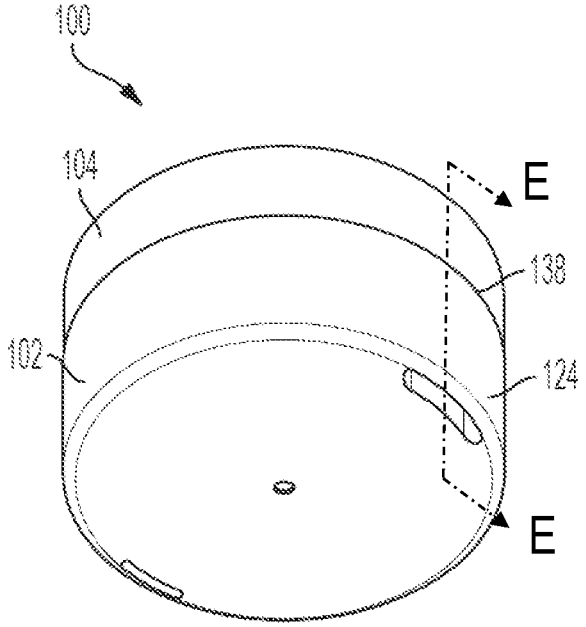
Figure 6C:
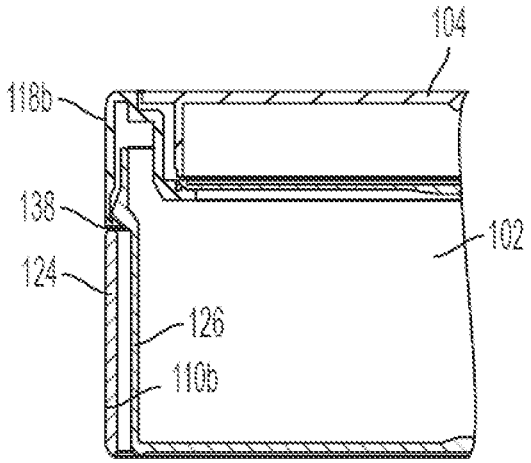
Figure 6B:
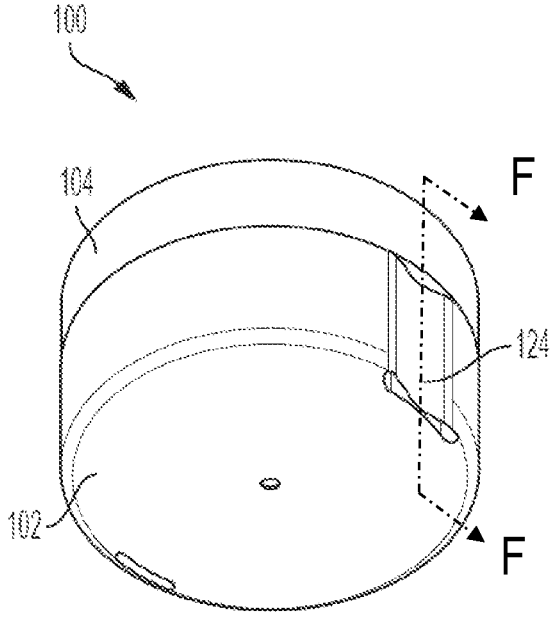
Figure 6D:
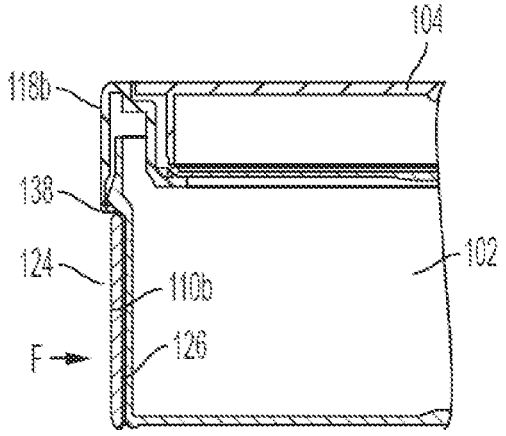
Figure 7:
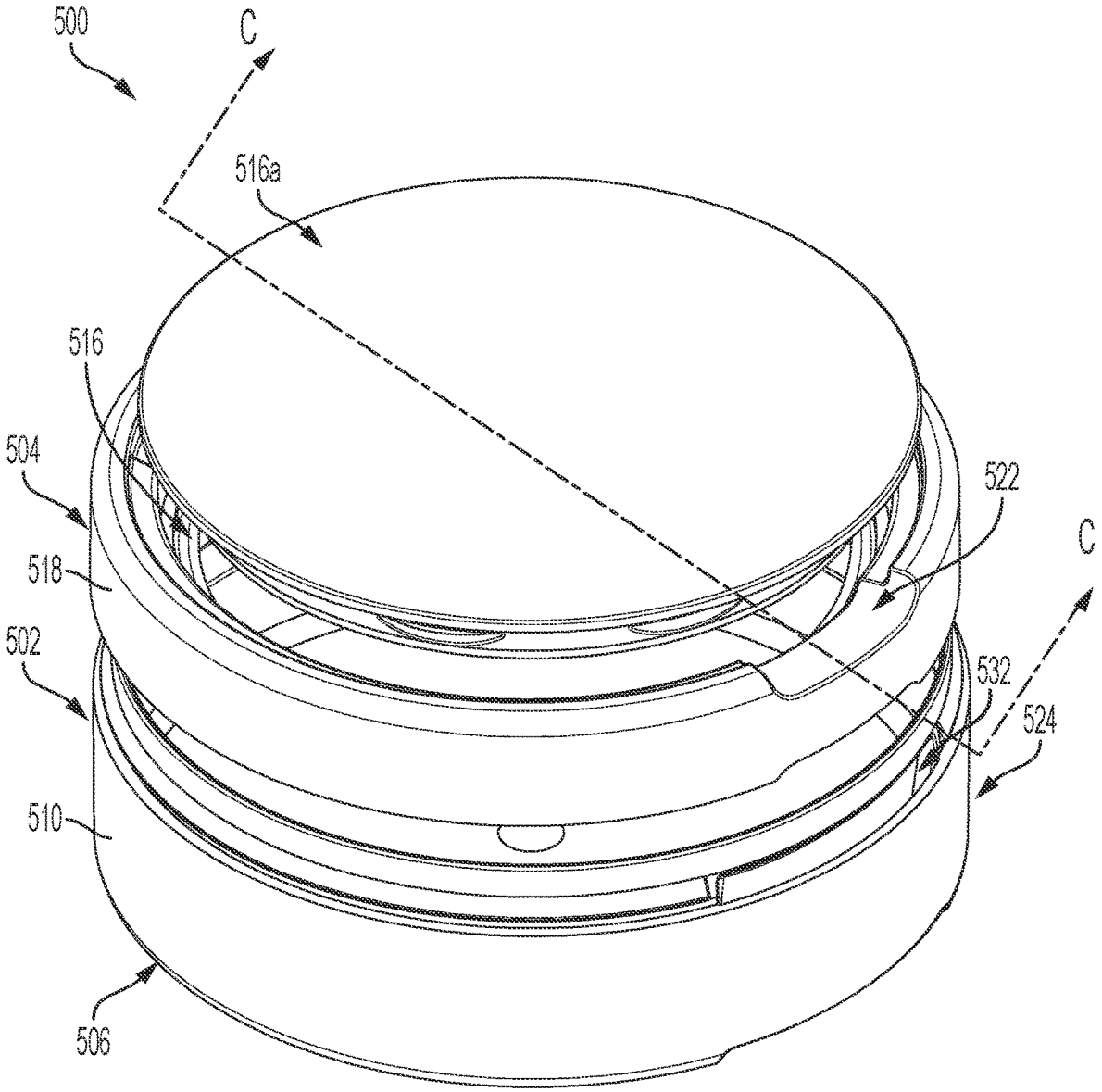
Figure 8:
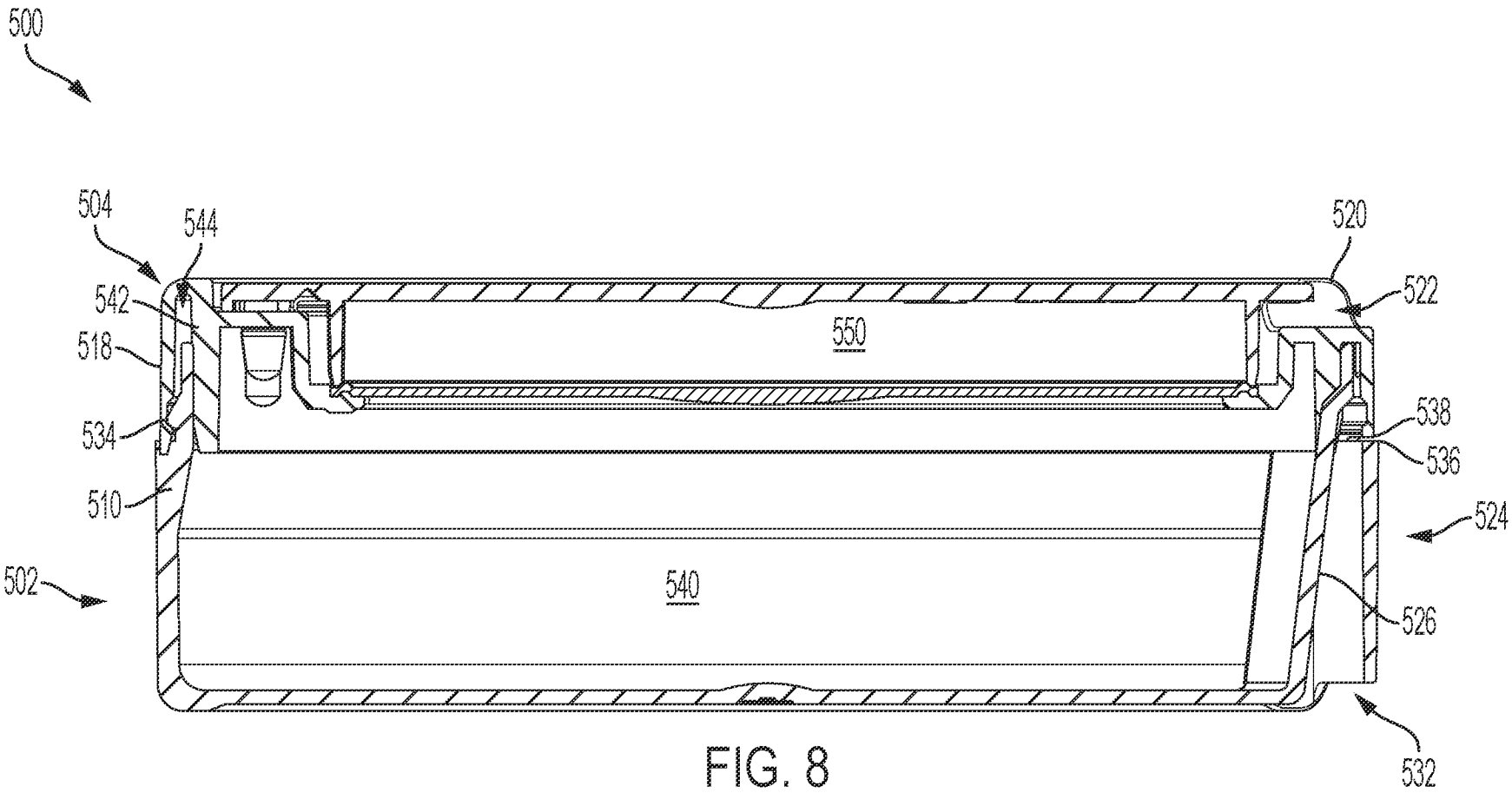
Figure 9A:
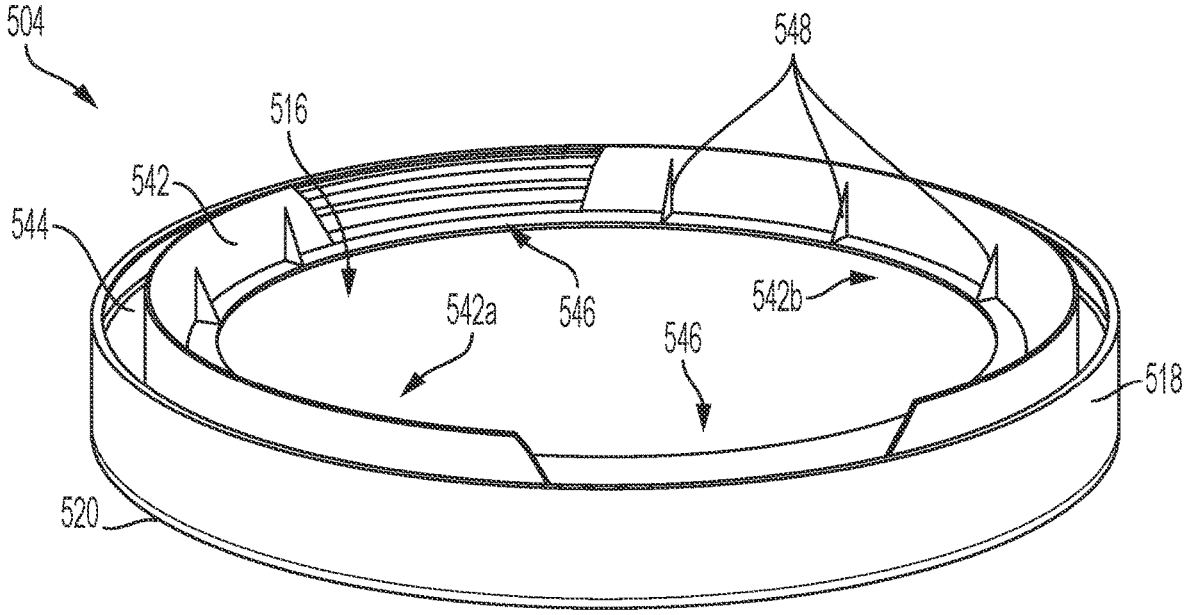
Figure 9B:
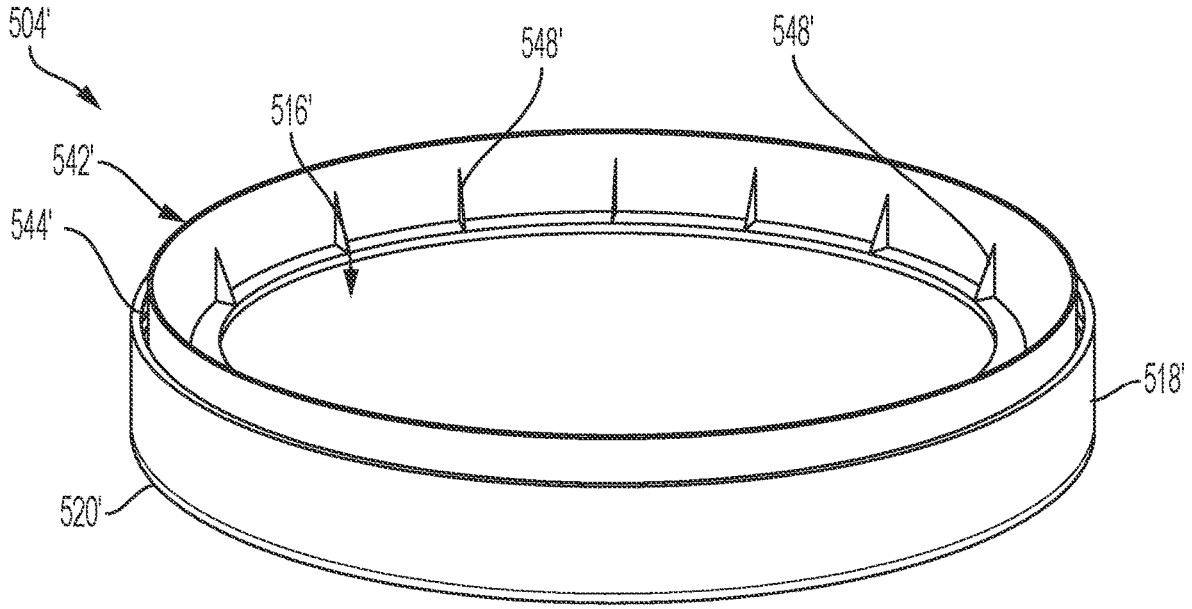
Figure 10:
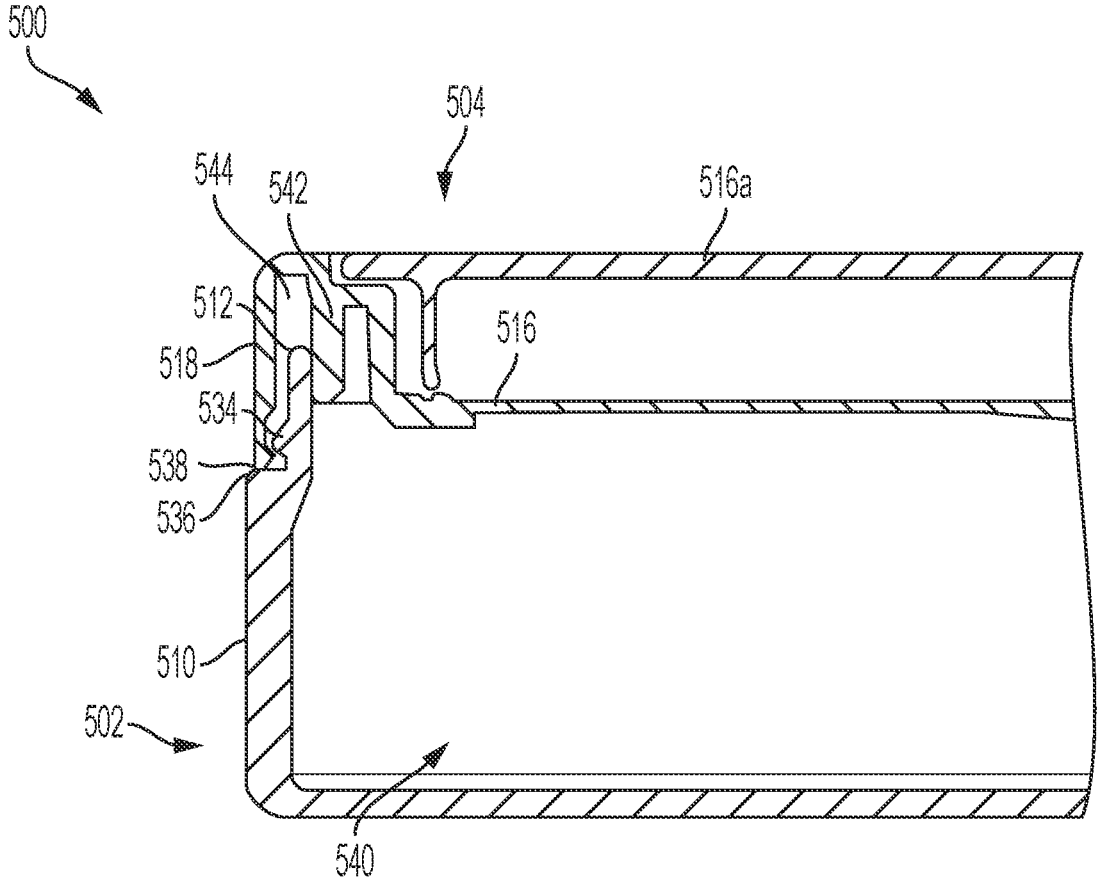
Figure 11:
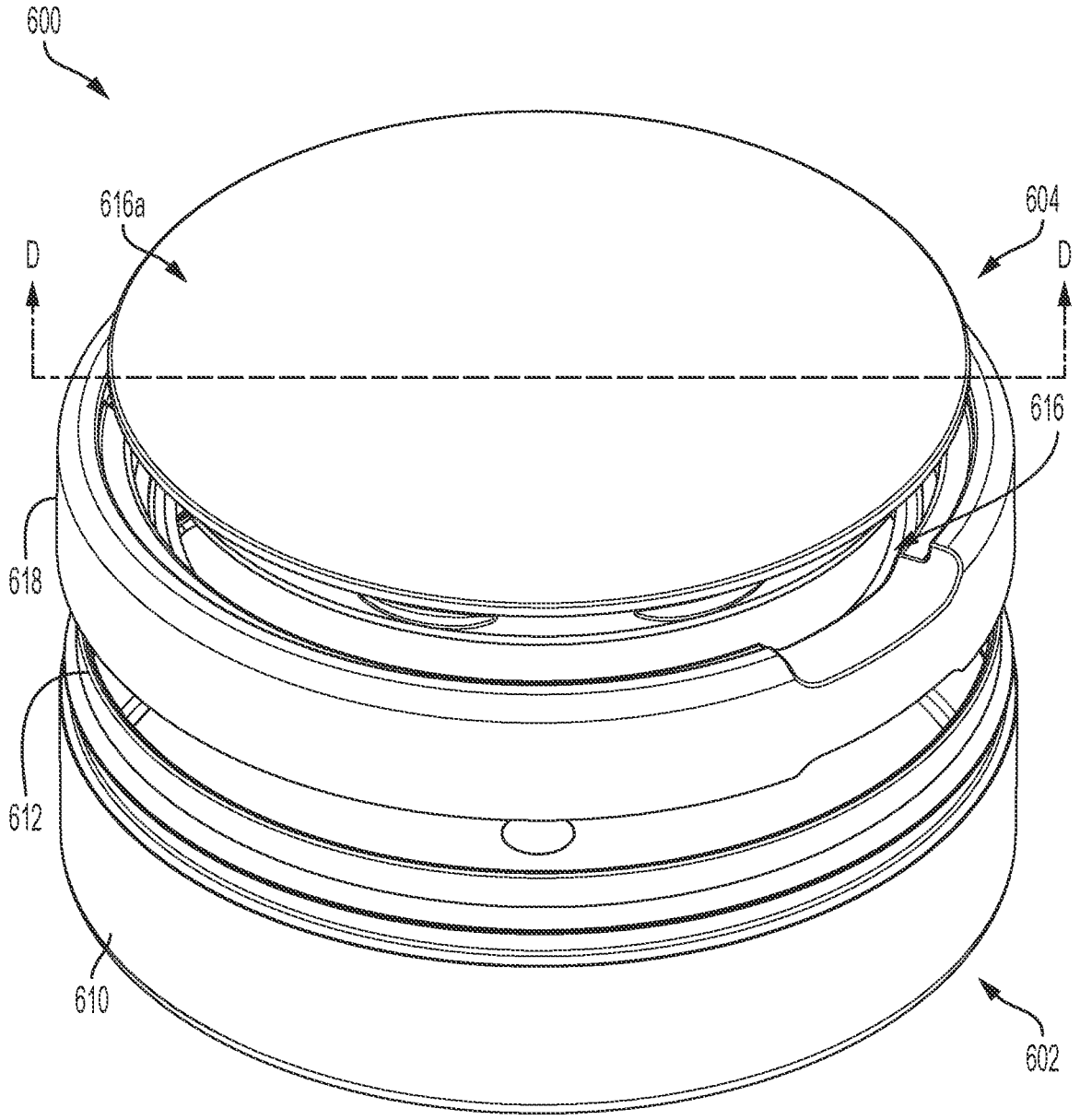
Figure 12:
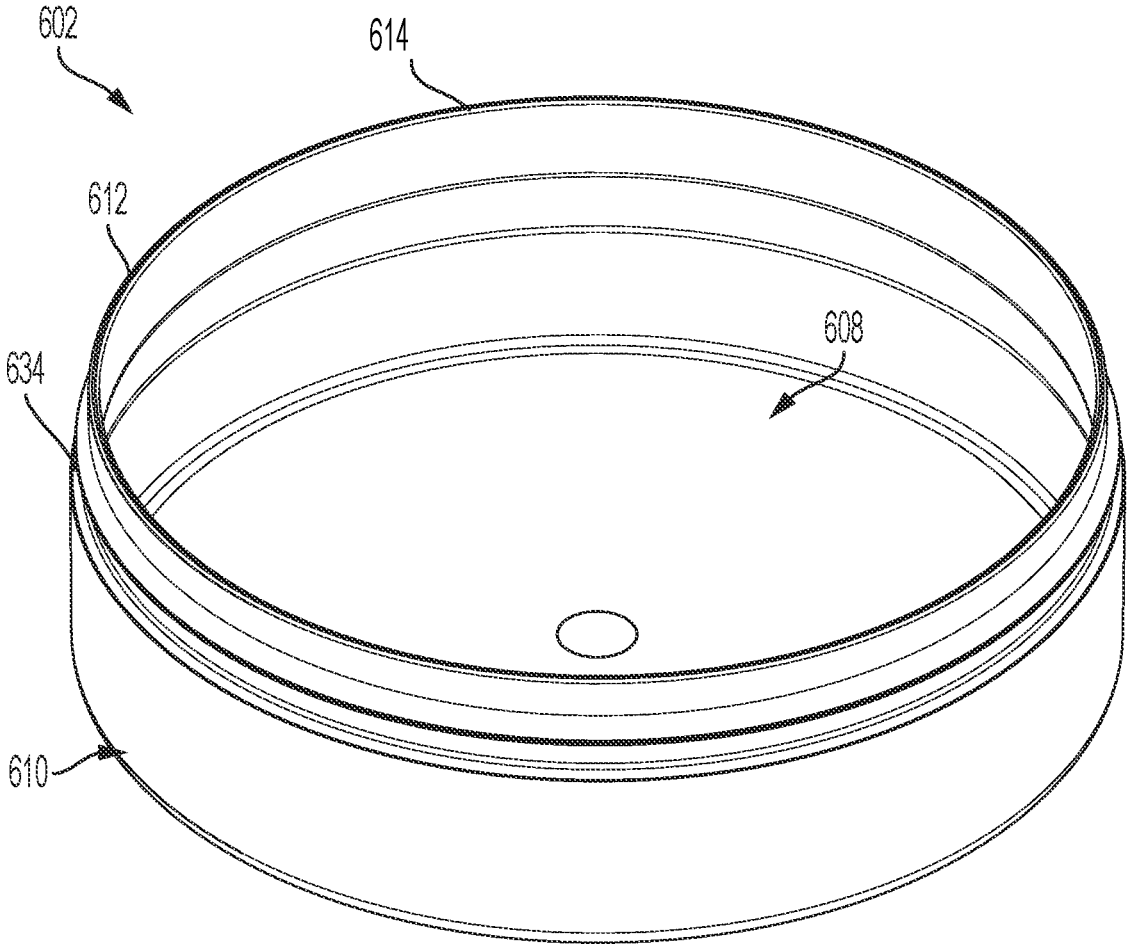
Figure 13:
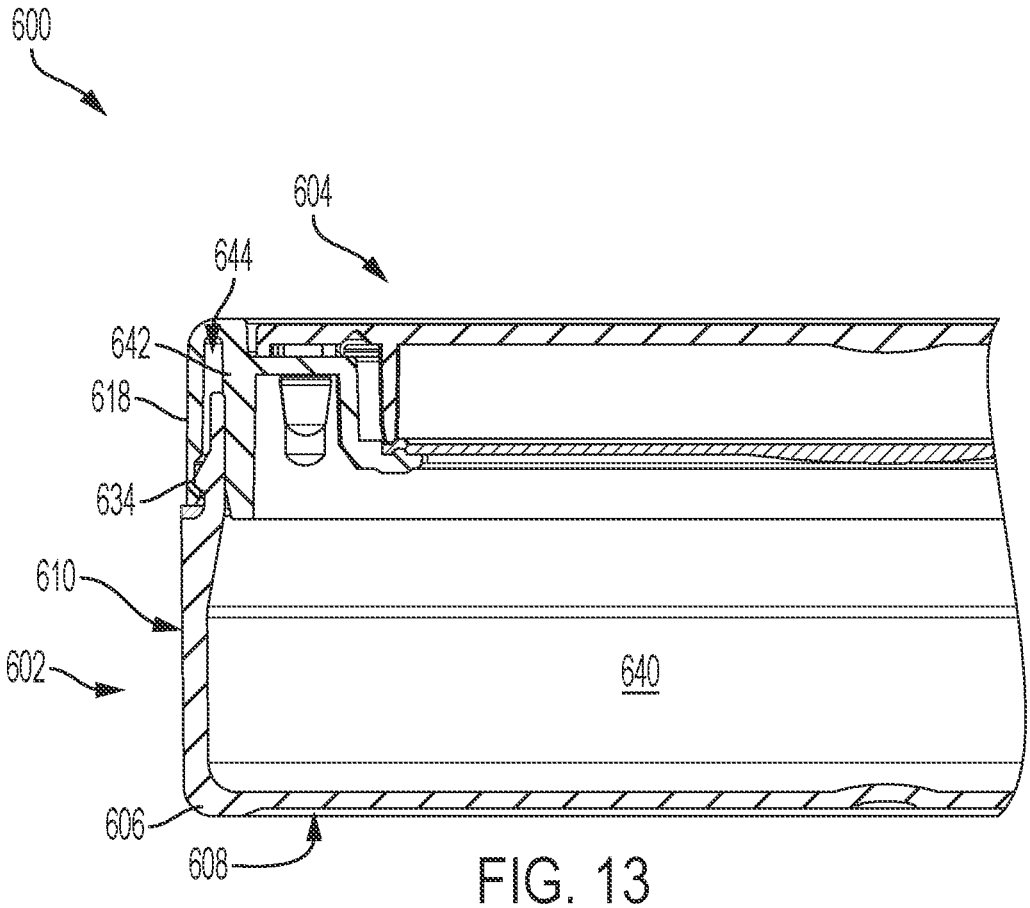

Having thus described aspects of the disclosure in the foregoing general terms, reference will now be made to the accompanying figures, which are not necessarily drawn to scale, and wherein:

FIG. 1A is a schematic perspective view of a child resistant container for holding a tobacco-containing material according to some example implementations of the present disclosure;

FIG. 1B is a schematic exploded perspective view of the child resistant container of FIG. 1A according to some example implementations of the present disclosure;

FIG. 2 is a schematic cross-sectional view of the container of FIG. 1A taken at line A-A in FIG. 1A according to some example implementations;

FIG. 3 is a schematic cross-sectional perspective view of the body portion of the container of FIG. 1A taken at line B-B in FIG. 2 according to some example implementations;

FIGS. 4A-4D are schematic top, side, front, and bottom views of the body portion of FIG. 3 according to some example implementations;

FIGS. 5A-5G are pictorial representations of alternative body portions for a container according to some example implementations;

FIGS. 6A and 6B are pictorial bottom perspective views and FIGS. 6C and 6D are corresponding cross-sectional views taken at lines E-E and F-F of FIGS. 6A and 6B, respectively, illustrating the operation of a child resistant container according to some example implementations of the present disclosure;

FIG. 7 is a schematic exploded perspective view of another child resistant container for holding a tobacco-containing material according to some example implementations of the present disclosure;

FIG. 8 is a schematic cross-sectional view of the container of FIG. 7 taken at line C-C in FIG. 7 according to some example implementations;

FIGS. 9A and 9B are schematic bottom perspective views of two different cover configurations for the container of FIG. 7 according to some example implementations;

FIG. 10 is an enlarged pictorial cross-sectional view illustrating the engagement the cover and a body portion of the child resistant container of FIG. 7 according to some example implementations of the present disclosure;

FIG. 11 is a schematic exploded perspective view of another child resistant container for holding a tobacco-containing material according to some example implementations of the present disclosure;

FIG. 12 is a schematic perspective view of the body portion of the container of FIG. 11 according to some example implementations of the present disclosure; and FIG. 13 is an enlarged pictorial cross-sectional view illustrating the engagement the cover and a body portion of the child resistant container of FIG. 11 taken at line D-D in FIG. 11 according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably.

Example implementations of the present disclosure are generally directed to containers used to store various solid products, but are particularly well-suited for products designed for oral consumption. Exemplary consumable products that are often packaged in such containers include a wide variety of consumer products, including tobacco products of the type that have a smokeless form. Various forms of suitable smokeless tobacco products are those types products set forth and described generally in U.S. Patent Pub. Nos. 2012/0193265 to Patel et al. and 2013/0206153 to Beeson et al.; which are incorporated by reference herein. Of particular interest, are exemplary tobacco products that include tobacco formulations in a loose form, such as moist snuff products. Other exemplary types of smokeless tobacco products include the types of products set forth in U.S. Pat. No. 2012/0024301 to Carroll et al., the disclosure of which is incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

The shape of the outer surface of the containers of the disclosure can vary. Although the container embodiments illustrated in the drawings have certain contours and shapes, containers with other exterior and interior surface designs also can be suitably adapted and used. For example, the sides or edges of the containers of the disclosure can be flattened, rounded, or beveled, and the various surfaces or edges of the container exterior can be concave or convex. Further, the opposing sides, ends, or edges of the container can be parallel or non-parallel such that the container becomes narrower in one or more dimensions. See, for example, the types of containers, components, component arrangements and configurations, and constructions thereof set forth in U.S. Pat. No. 8,458,996 to Bried et al., U.S. Pat. No. 8,910,781 to Pipes et al., and D649,284 to Patel et al.; U.S. Patent Pub. No. 2010/0018883 to Patel et al; as well as the various types of containers referenced in U.S. Patent Pub. No. 2013/0206153 to Beeson et al.; each of which is incorporated by reference herein.

The dimensions of the containers described herein can vary without departing from the disclosure. However, in certain embodiments, the containers can be described as having a cylindrical shape suitable for handheld manipulation and operation. Exemplary dimensions for such handheld generally cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is comparable in many regards to that which has been used for commercially available GRIZZLY and KODIAK products that are marketed by American Snuff Company, LLC.

Further, the size of the containers described herein may be changed. For example, the containers may be sized for promotional purposes by providing either increased or decreased dimensions. For example, the dimensions of the containers may be scaled upwardly or downwardly by certain multipliers. By way of further example, the dimensions of the container may be scaled upwardly or downwardly by a multiple of about 1 to about 10 times. In this regard, whereas a conventional container according to embodiments of the present disclosure may be configured to store about 1.2 ounces of a tobacco-containing material, an oversized container may be configured to store, for example, 2.4 ounces or 7.2 ounces of the tobacco containing material. In specialty markets the containers may define a larger cylindrical configuration having a diameter from about 100 mm to about 125 mm (e.g., about 114 mm) and a depth from about 30 mm to about 50 mm (e.g., about 38 mm). Accordingly, the dimensions and capacities disclosed herein are provided for example purposes only and may be modified to suit particular purposes.

FIGS. 1A, 1B, and 2, depict a first example implementation of a container 100 in accordance with one or more embodiments of the disclosure, with FIGS. 4A-4D depicting the base portion 102 in greater detail. The container 100 includes a base or body portion 102 that is typically configured to hold the consumer product and a lid or cover 104 configured to be securely, but removably, coupled to the body portion 102. As shown in FIG. 1A, the cover 104 and body portion 102 abut one another when engaged and their respective outer surfaces are substantially flush with one another, which makes it difficult to separate the two parts. In some implementations, the cover 104 is secured to the body portion 102 via a snap or interference fit, which provides additional resistance to separating the two parts. The engagement of the cover 104 and body portion 102 are shown in greater detail and described with respect to FIG. 2 below.

The body portion 102 includes a bottom wall 108 and a sidewall 110 extending upwardly from, and about, a peripheral edge 106 (506 in FIGS. 7 and 606 in FIG. 13) of the bottom wall 108. The sidewall 110 has a top edge or upper rim 112 (512 in FIGS. 10 and 612 in FIG. 11) that in turn defines an opening 114 through which the contents of the container 100 may be accessed. The material of construction of the body portion 102 may vary to suit a particular application. Exemplary materials include metal, synthetic plastic materials, and cellulosic materials (e.g., cardboard). Polymeric materials that can be extruded and/or molded into desired shapes are typically utilized, such as polypropylene, polyethylene, polystyrene, polyamide, and the like. The body portion 102 may be manufactured via injection molding, blow molding, thermoforming, extrusion, bonding, machining, or combinations thereof, as known to a person of skill in the art.

The cover 104 includes a top wall 116 (or outer lid 116*a* depending on configuration) (616 and 616*a* in FIG. 11) and a sidewall 118 that extends downwardly, and about, a peripheral edge 120 of the top wall 116. In some implementations, the top wall 116 spans the entire area bounded by its peripheral edge 120, while in other configurations, the top wall 116 does not span the entire area and forms a frame for accepting an outer lid 116*a* secured thereto, as shown in FIG. 1B. In some implementations, the cover 104 includes a recess 122 (522 in FIG. 7) or similar structure that may, for example, assist a user in handling the container 100 and/or manipulating the cover 104. For example, the recess 122 may allow a user to pry open the outer lid 116*a* (e.g., by using a tool or finger nail) to access an internal space 150 between the top wall 116 and outer lid 116*a*. The internal space 150 (550 in FIG. 8) may be used to hold or store waste or spent materials. In some implementations, the cover 104 may be made of the same materials and by the same processes as the body portion 102. In certain implementations, the cover 104 may be formed from a metallic material, such as, for example, aluminum or tinplate. In implementations incorporating the outer lid 116*a*, it may be manufactured separately from and of a different material than the remainder of the cover 104 to, for example, provide labeling or other indicia or to serve an aesthetic purpose.

FIGS. 3 and 4A-4D depict the body portion 102 in greater detail. The bottom wall 108 and sidewall 110 define an internal space 140 (540 in FIG. 8), which may be accessible via the opening 114 when the cover 104 is removed therefrom. The internal space 140 of the body portion 102 may be configured to receive a tobacco-containing material, which may comprise any of the various tobacco-containing materials described herein. While the sidewall 110 depicted in the figures is a single, contiguous circular wall, the sidewall 110 may comprise multiple wall portions as would be necessary, for example, if the container 100 had a non-cylindrical shape (e.g., rectangular, octagonal, etc.). The sidewall 110 includes at least one flex feature 124 that assists in separating the cover 104 and body portion 102, but provides sufficient resistance to the cover 104 and body portion 102 being separated by a child.

Figure 4A:
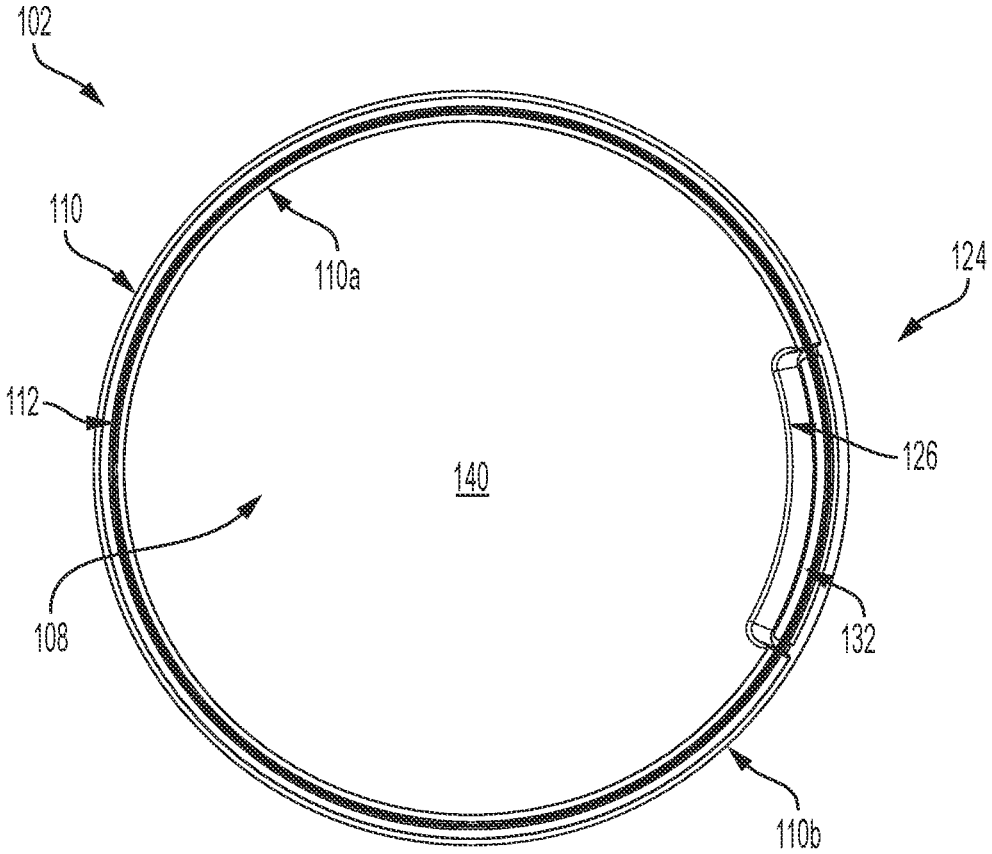
Figure 4B:
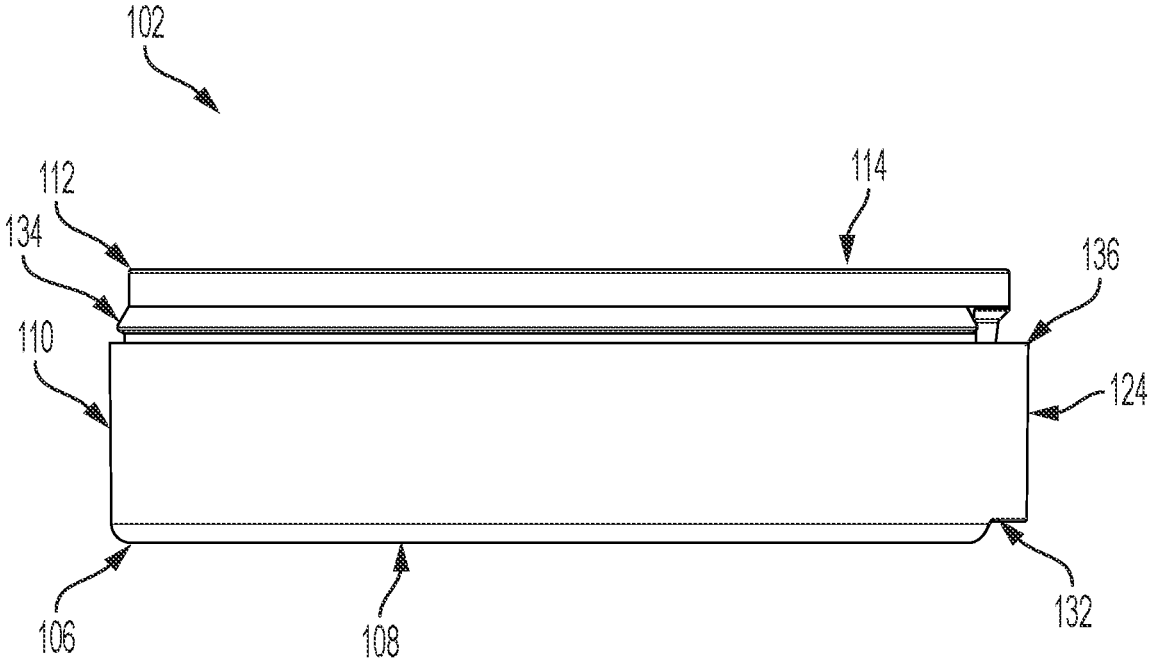
Figure 4C:
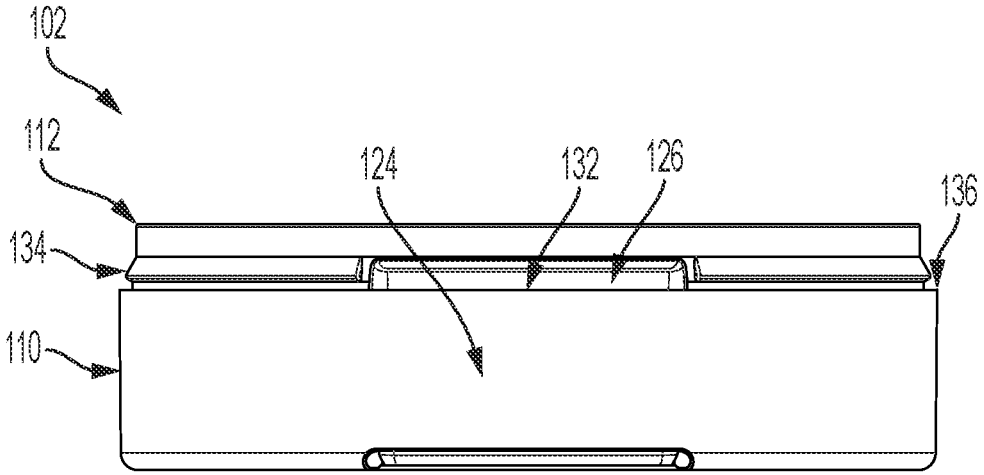
Figure 4D:
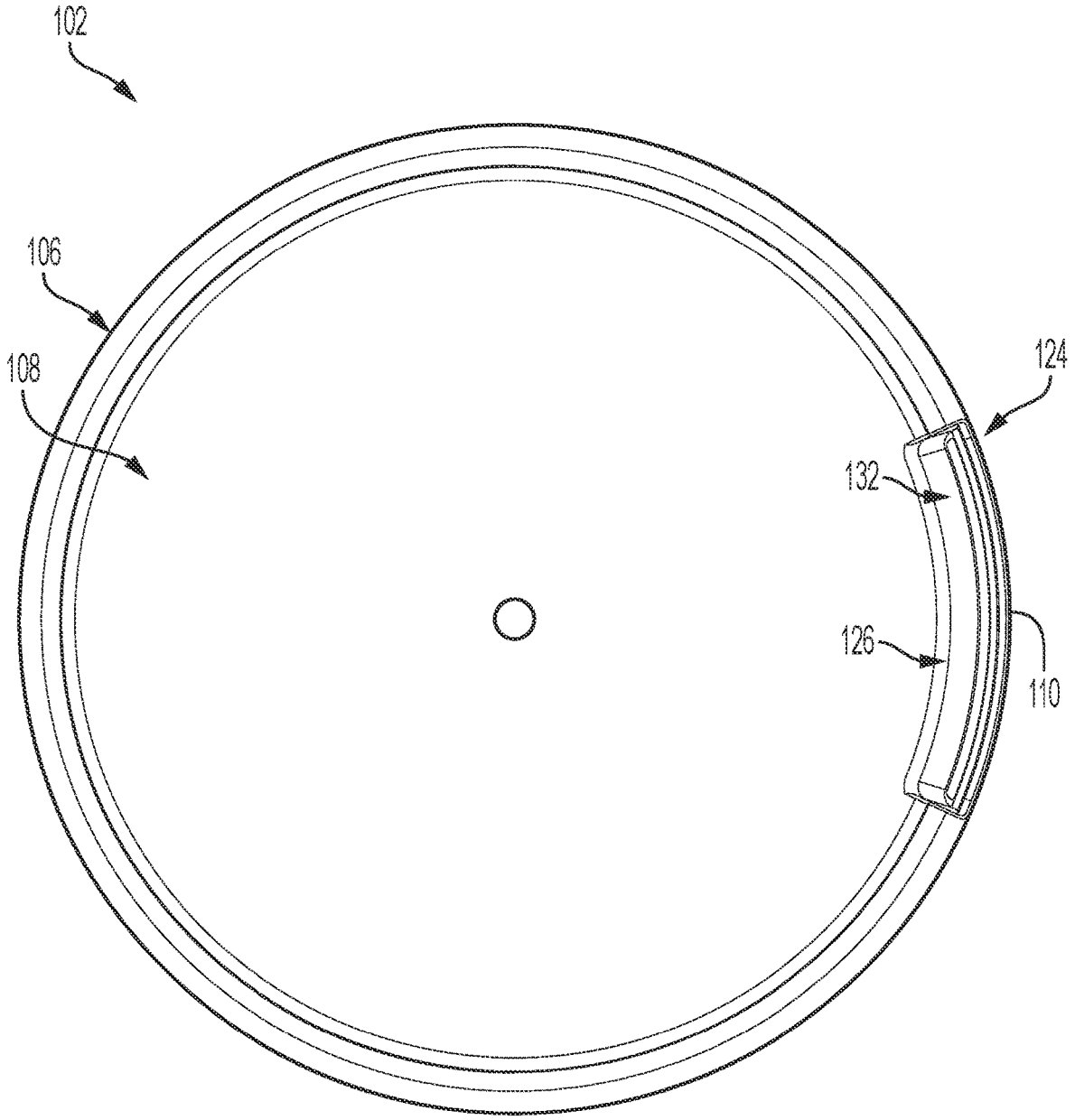

As shown in FIGS. 3 and 4A, the sidewall 110 extends around the entire perimeter of the body portion 102 and has an inner surface 110*a* and an outer surface 110*b*. The flex feature 124 may be formed in the sidewall 110 in different manners. In one implementation, the sidewall 110 is the primary wall and the body portion 102 includes at least one secondary wall 126. The secondary wall 126 (526 in FIG. 8) includes first and second vertical edges 128*a*, 128*b* and top and bottom horizontal edges 130*a*, 130*b*. The vertical edges 128*a*, 128*b* join with the inner surface 110*a* of the sidewall 110, such that the secondary wall 126 extends inwardly from the inner surface 110*a*, partially surrounds a portion of the primary sidewall 110, and defines a channel 132 (532 in FIG. 8) between the primary and secondary walls. The bottom horizontal edge 130*b* of the secondary wall 126 joins with the bottom wall 108 at its peripheral edge 106. The channel 132 extends essentially the entire height of the body portion 102 with an upper opening of the channel 132 disposed proximate the top rim 112 of the body portion and a lower opening of the channel 132 disposed proximate the peripheral edge of the bottom wall 108.

The channel configuration allows the primary sidewall 110 to be flexed inwardly (i.e., depressed towards the secondary wall 126) upon application of a force to the outer surface 110*b*, thereby providing access to a bottom edge 138 of the cover 104 to assist in removing the cover 104. See FIGS. 2 and 6 for additional details regarding the removal of the cover 104. The amount of force required may vary to suit a particular application and may depend on, for example, the wall thicknesses, materials of construction, and/or the size of the channel 132 or channel openings. The container 100 may be configured to meet any minimum force required to make the container child proof, such as, for example, materials of construction and number of and location of certain structural features. Additionally, although only one flex feature 124 is shown in FIGS. 3 and 4, essentially any number of flex features 124 may be included and disposed about the perimeter of the body portion 102, for example, they may be spaced equidistant about the body portion. See FIG. 5A, which depicts three flex features 424 disposed about 120° apart about the perimeter of a body portion 402. Furthermore, the size, shape, and visibility of the channel openings may vary to suit a particular application. For example, the height of the sidewall 110 at the flex feature 124 may be reduced so that the channel opening is larger and more readily visible to a user to, for example, provide a visible clue to the location of the flex feature 124 when the cover 104 is engaged with the body portion 102. See, for example, FIGS. 5B-5D, which depict three different sidewall heights at the flex feature 124, 224, 324. Specifically, as the height (or overall vertical length of the sidewall) is reduced, the openings of the channel 132, 232, 332 are increased, thereby rendering the flex feature 124, 224, 324 more visible to a user. In addition, a tactile feature may be included on the flex feature, such as, for example, a protuberance or other minimally raised structure that a user can feel when gripping the container. Additionally or alternatively, the side wall of the body portion 102, 202, 302 may include a structure that provides an audible cue when engaged, for example, a force is applied.

In another implementation of a flex feature 124, the sidewall 110 is a continuous wall having the aforementioned inner and outer surfaces 110*a*, 110*b* and including one or more gaps therebetween and extending along a length of the sidewall 110, thereby forming the channel(s) 132. Similar to the flex feature 124 described above the channel 132 extends essentially the entire height of the body portion 102 with an upper gap or opening of the channel 132 disposed proximate the upper rim 112 of the body portion and a lower gap or opening of the channel 132 disposed proximate the peripheral edge of the bottom wall 108.

Referring to FIGS. 2 and 6, the engagement between the body portion 102 and cover 104 are clearly depicted. As shown and previously described, the body portion 102 includes a bottom wall 108 and a sidewall 110 extending upwardly therefrom and defining a flex feature 124, and the cover 104 includes a top wall 116 and a sidewall 118 extending downwardly therefrom. An upper region of the body portion sidewall 110 is configured to engage with at least a portion of the cover sidewall 118. As shown, an inner surface 118*a* of the cover sidewall 118 engages with the outer surface 110*b* of the body portion sidewall 110 via an interference or snap fit. In some implementations, the sidewalls 110, 118 include mating structure 134 to enable the snap fit. The bottom edge 138 of the cover sidewall 118 abuts against a top edge of or recess 136 (536 in FIG. 8) in the body portion sidewall 110 and, in some embodiments, the outer surface 118*b* of the cover 104 sits flush with or slightly inward of the outer surface 110*b* of the sidewall 110 to make it difficult to engage with and remove the cover 104 from the body portion 102. See FIG. 6A.

To remove the cover 104, a user applies a force (F) to the outer surface 110*b* of the sidewall (i.e., depresses the sidewall 110) at the flex feature 124, thereby exposing the bottom edge 138 of the cover sidewall 118, as shown in FIG. 6B. This allows the user to apply a force to the bottom edge 138 (e.g., via the use of a tool or finger nail) sufficient to overcome the holding force of the interference or snap fit, thereby separating the cover 104 from the body portion 102. For example, a fingernail can be used to apply the force (F) and, in some cases, inserted into the gap of the flex feature 124 and/or into a space behind the sidewall 118 of the cover 104 to remove the cover/lid while the force is applied. The user can release (i.e., remove the applied force) the flex feature 124 and the body portion 102 returns to its neutral/normal or unflexed configuration. The cover 104 can be reattached to the body portion 102 by pushing the cover back onto the body portion with sufficient force to reengage the interference or snap fit, which should be evident once the cover and body portion are back in an abutting configuration as described above.

FIGS. 7 and 8 depict another example implementation of a container 500 in accordance with one or more embodiments of the disclosure, with FIGS. 9A, 9B, and 10 depicting the cover 504 in greater detail. As shown, the container 500 includes the same or a substantially similar body portion 502 to that described above. Accordingly, the body portion 502 will not be discussed in any detail with respect to this implementation of the container 500.

Generally, the cover 504 of FIG. 7 is similar to the cover 102 of FIG. 1B; however, cover 504 includes additional structure to provide further resistance to opening the container 500 by a child. Specifically, the modified cover 504 is configured to increase the rigidity of the cover and the amount of opening force required to remove the cover 504 from the body portion 502 even after the flex feature 524 is engaged.

As shown in FIGS. 7-10, the cover 504, 504' includes a top wall 516, 516' (or outer lid 516*a* depending on configuration) and a sidewall 518, 518' that extends downwardly, and about, a peripheral edge 520, 520' of the top wall 516, 516'. In some implementations, the top wall 516, 516' spans the entire area bounded by its peripheral edge 520, 520', while in other configurations, the top wall 516, 516' does not span the entire area and forms a frame for having an outer lid 516*a* secured thereto. In some implementations, the cover 504, 504' may be made of the same materials and by the same processes as those described above.

FIGS. 9A and 9B depict two different implementations of the additional child-resistant feature in greater detail. Both covers 504, 504' include an additional inner ring or sidewall 542, 542' extending downwardly from the top wall 516, 516' (shown upwardly extending in the figures because they are bottom perspective views). The inner ring 542, 542' is spaced inwardly of the sidewall 518, 518' and configured to define a receptacle 544, 544' therebetween that provides for an interference fit with the sidewall 510 of the body portion 502. The inner ring 542, 542' also provides additional rigidity to the overall cover 504, which may further provide resistance to its removal from the body portion. In some implementations, the cover 504, 504' and body portion 502, engage via a snap fit and the additional rigidity of the inner ring 542, 542' further strengthens that engagement.

In various implementations, the inner ring or sidewall 542, 542' has a height greater than the height of the sidewall 518, 518' (i.e., the inner ring extends further from the top cover than the sidewall), however the height of the inner ring 542, 542' may be about the same or even less than the height of the sidewall 518, 518' to suit a particular application. In some implementations, the height of the inner ring may vary along its length. Additionally, the cover may include one or more buttresses 548, 548' (or similar structure) spaced about an inner perimeter of the inner ring 542, 542' and coupled to the top wall 516, 516'. The buttresses 548, 548' may be spaced equidistant about the inner perimeter of the inner ring.

As shown in FIG. 9B, the inner ring 542' is a single continuous wall; however, the inner ring may comprise a plurality of contiguous walls to accommodate other (e.g., non-circular) shapes. As shown in FIG. 9A, however, the inner ring 542 may include a plurality of segments 542*a*, 542*b* spaced relative to and about the sidewall 518. The length and the number of the segments 542*a*, 542*b*, and the spaces 546 therebetween, may vary to suit a particular application, for example, the size and shape of the container and the desired opening force. In some implementations, the segments 542*a*, 542*b* are non-contiguous, but in others, the segments may be defined by recesses or cut-outs in the inner ring 542' depicted in FIG. 9B. In some implementations, these recesses or spaces 546 between segments may be disposed on opposite sides of the cover to provide assistance in gripping the cover 504 and aiding in its removal from the body portion by an adult hand.

FIG. 10 is an enlarged cross-sectional view of a portion of the container that provides a better view of the cover 504 and body portion 502 engagement. As shown, the cover 504 engages with the body portion 502 via insertion of the body portion sidewall 510 into the receptacle 544 defined by the sidewall 518 and inner ring 542 of the cover 504. In some implementations, the cover engages the sidewall 510 with an interference or frictional fit. However, as shown in FIG. 10, the container 500 includes a snap fit mechanism 534 and the inner ring 542 provides resistance to the inward flexing of the top portion of the body portion sidewall 510, thereby requiring additional force to remove the cover, even where the flex feature 524 (not shown in FIG. 10) is used to expose the edge 538 of the cover 504.

FIG. 11 depicts another example implementation of a container 600 in accordance with one or more embodiments of the disclosure, with FIG. 12 depicting the body portion 602 in greater detail. As shown, the container 600 includes the same or a substantially similar cover 604 to that described above. Accordingly, the cover 604 will not be discussed in any detail with respect to this implementation of the container 600.

FIG. 12 depicts the body portion 602 in greater detail. The bottom wall 608 and sidewall 610 define an internal space 640, which may be accessible via the opening 614 when the cover 604 is removed therefrom. The internal space 640 of the body portion 602 may be configured to receive a tobacco-containing material, which may comprise any of the various tobacco-containing materials described herein. While the sidewall 610 depicted in the figures is a single, contiguous circular wall, the sidewall 610 may comprise multiple contiguous wall portions as would be necessary, for example, if the container 600 had a non-cylindrical shape (e.g., rectangular, octagonal, etc.). In some implementations, the body 602 may be made of the same materials and by the same processes as those described above.

FIG. 13 is an enlarged cross-sectional view of a portion of the container that provides a better view of the cover 604 and body portion 602 engagement. As shown, the cover 604 engages with the body portion 602 via insertion of the body portion sidewall 610 into the receptacle 644 defined by the sidewall 618 and inner ring 642 of the cover 604. In some implementations, the cover engages the sidewall 610 with an interference or frictional fit. However, as shown in FIG. 12, the container 600 includes a snap fit mechanism 634 and the inner ring 642 provides resistance to the inward flexing of the top portion of the body portion sidewall 610, thereby requiring additional force to remove the cover.

In various implementations of the containers described herein, the containers may include additional features, such as a barrier film or membrane configured to cover the opening in the body portion, thereby enclosing the internal space. By way of example, the barrier film may comprise a foil or a film (e.g., a polymer film) and/or may contain a material selected and configured to be substantially fluid-impervious so as to prevent the flow of fluids from the internal space to an external environment or allow the transmission of gasses therethrough (e.g., diffusion of oxygen into the internal space) to maintain the freshness of the tobacco-containing material by supporting the health of aerobic microbes within the tobacco-containing material. Another feature that may be included is a vent mechanism disposed in the body portion, the cover, or both to help regulate an internal pressure or other environmental condition within the container.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A container comprising:

a body portion defining an internal space accessible via an opening, the body portion comprising a bottom wall and a sidewall extending upwardly from a peripheral edge of the bottom wall, wherein the sidewall comprises:

a primary wall extending along a perimeter of the bottom wall and having an inner surface and an outer surface and an upper rim defining the opening; and a secondary wall spaced inwardly from and at least partially surrounding a portion of the inner surface of the primary wall thereby defining a channel between the primary and secondary walls, wherein the secondary wall comprises a first vertical edge, a second vertical edge, a top horizontal edge, and a bottom horizontal edge and the secondary wall is coupled to the primary wall along the first and second vertical edges, further defining the channel between the primary wall and the secondary wall and extending from the top horizontal edge of the secondary wall and the primary wall proximate the upper rim and the bottom horizontal edge of the secondary wall and the primary wall proximate the peripheral edge of the bottom wall, such that a portion of the primary wall flexes relative to the secondary wall upon application of a force thereto; and a cover configured to securely and removably engage the body portion, wherein the cover comprises:

a top wall;

a cover sidewall extending downwardly from and about a peripheral edge of the top wall; and an inner ring extending downwardly from the top wall and spaced inwardly from the cover sidewall, wherein an outer surface of the inner ring is configured to engage the inner surface of the primary wall.

2. The container of claim 1, wherein the inner ring and the cover sidewall define a receptacle configured to engage at least a portion the sidewall of the body portion via an interference fit or a snap fit.

3. The container of claim 1, wherein the primary wall returns to an unflexed position after removal of the force.

4. The container of claim 1, wherein the cover sidewall is configured to engage the outer surface of the primary wall.

5. The container of claim 1, wherein the cover is removable by flexing the portion of the primary wall aligning with the secondary wall inwardly to expose an edge of the cover sidewall.

6. The container of claim 1, wherein an outer surface of the cover sidewall is configured to sit flush with the outer surface of the primary wall of the body portion when engaged.

7. The container of claim 6, wherein at least a portion of the cover sidewall and a portion of the body portion sidewall abut when engaged.

8. The container of claim 1, wherein the secondary wall comprises a plurality of secondary walls, each spaced inwardly from and at least partially surrounding respective portions of the inner surface of the primary wall, each one of the plurality of secondary walls and each of the respective portions of the inner surface of the primary wall defining a channel therebetween, wherein each one of the plurality of secondary walls comprises a first vertical edge, a second vertical edge, a top horizontal edge, and a bottom horizontal edge and each one of the plurality of secondary walls is coupled to the primary wall along their respective first and second vertical edges, further defining the channels between the respective portions of the primary wall and the secondary walls and extending from the top horizontal edges of the secondary walls and the respective portions of the primary wall proximate the upper rim and the bottom horizontal edge of the secondary walls and the respective portions of the primary wall proximate the peripheral edge of the bottom wall, such that such that the respective portions of the primary wall flex relative to the plurality of secondary walls upon application of the force thereto.

9. The container of claim 8, wherein the plurality of secondary walls are spaced equidistant about a perimeter of the body portion.

10. The container of claim 1, wherein the inner ring comprises a plurality of non-contiguous segments.

* * * * *